US008572932B2

(12) United States Patent
Bierschenk et al.

(10) Patent No.: US 8,572,932 B2
(45) Date of Patent: Nov. 5, 2013

(54) METHOD AND APPARATUS FOR MAKING A FLAT BOTTOM PILLOW POUCH

(75) Inventors: Patrick Joseph Bierschenk, Dallas, TX (US); Martin Bernhard Dierl, Allen, TX (US); Chad Arthur Huebner, Hurst, TX (US); Jerry Mike Reaves, Midlothian, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 334 days.

(21) Appl. No.: 13/218,546

(22) Filed: Aug. 26, 2011

(65) Prior Publication Data

US 2012/0055120 A1 Mar. 8, 2012

Related U.S. Application Data

(63) Continuation-in-part of application No. 12/046,170, filed on Mar. 11, 2008.

(51) Int. Cl.
*B65B 9/10* (2006.01)
*B65B 9/20* (2012.01)

(52) U.S. Cl.
USPC ..... 53/451; 53/551

(58) Field of Classification Search
CPC ..... B65B 9/10; B65B 9/20
USPC ..... 53/451, 479, 551, 374.7, 375.2
IPC ..... B65B 9/10, 9/20
See application file for complete search history.

(56) References Cited

U.S. PATENT DOCUMENTS

| | | | | | |
|---|---|---|---|---|---|
| 3,774,509 | A | * | 11/1973 | Heinzer | 493/235 |
| 3,973,474 | A | * | 8/1976 | Auckenthaler | 493/197 |
| 4,079,662 | A | * | 3/1978 | Puccetti et al. | 53/552 |
| 4,230,030 | A | * | 10/1980 | Hanson et al. | 493/194 |
| 4,562,691 | A | * | 1/1986 | Rapparini | 53/552 |
| 4,892,511 | A | * | 1/1990 | Luciano et al. | 493/194 |
| 4,929,224 | A | * | 5/1990 | Hanson et al. | 493/194 |
| 5,505,040 | A | | 4/1996 | Janssen et al. | |
| 6,718,739 | B2 | | 4/2004 | Kohl et al. | |
| 7,189,300 | B2 | | 3/2007 | Knoerzer | |
| 7,197,859 | B2 | | 4/2007 | Knoerzer et al. | |
| 7,299,608 | B2 | * | 11/2007 | Kohl et al. | 53/551 |
| 7,458,195 | B2 | | 12/2008 | Bezek et al. | |
| 7,681,377 | B2 | | 3/2010 | Simmons et al. | |
| 7,908,826 | B2 | | 3/2011 | Reaves et al. | |
| 2009/0232424 | A1 | | 9/2009 | Bierschenk et al. | |

FOREIGN PATENT DOCUMENTS

| | | | | | |
|---|---|---|---|---|---|
| GB | 2141395 | A | | 12/1984 | |
| JP | 2009214889 | A | * | 9/2009 | B65B 9/10 |

* cited by examiner

*Primary Examiner* — Stephen F Gerrity
(74) *Attorney, Agent, or Firm* — Bobby W. Braxton; Colin P. Cahoon; Carstens & Cahoon, LLP

(57) ABSTRACT

The present invention discloses a flat bottom pillow pouch that can stand upright on its bottom transverse seal. The flat bottom pillow bag can be made from the same film as a standard pillow pouch and requires less film than prior art stand up packages. The flat bottom pillow pouch disclosed herein has no gussets.

30 Claims, 22 Drawing Sheets

METHOD AND APPARATUS FOR MAKING A FLAT BOTTOM PILLOW POUCH

CROSS REFERENCE RELATED APPLICATION

This application is a continuation-in-part of co-pending U.S. patent application Ser. No. 12/046,170, filed Mar. 11, 2008, the technical disclosure of which is hereby incorporated by reference in its entirety.

BACKGROUND OF THE INVENTION

1. Technical Field

The present invention relates to a flat bottom pillow pouch constructed using a modified vertical form fill and seal packaging machine, and the method for making the same that provides for a single-piece construction of a bag suitable for retail snack food distribution.

2. Description of Related Art

Many snack foods, like chips, pretzels, etc. are packaged in pouches formed of a very thin packaging film. These packages can be manufactured on vertical form, fill, and seal packaging machines that, as the name implies, forms a package, fills it with product, and seals the filled package. An example of a vertical form, fill, and seal machine for making pillow-pouch packages is exemplified in FIG. 1 of U.S. Pat. No. 6,718,739. Such packaging machines take packaging film from a sheet roll and form the film into a vertical tube around a product delivery cylinder. The vertical tube is vertically-sealed along its length to form a back-seal. The machine applies a pair of heat-sealing jaws against the tube to form a transverse seal. This transverse seal acts as the top-seal on the bag below and the bottom-seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thereby making a bag and sealing the product within the bag while simultaneously forming a film tube above the product. The package below said transverse-seal is separated from the rest of the film tube by cutting across the sealed area. An example of the resultant standard pillow pouch bag is depicted by FIG. 3a of U.S. Pat. No. 6,722,106.

The packaging film used in such process is typically a composite polymer material produced by a film converter. For example, one prior art composite film used for packaging potato chips and like products in a standard pillow pouch bag uses a sealable inside, or product side, layer which typically comprises metalized oriented polypropylene ("OPP") or metalized polyethylene terephthalate ("PET"). A sealant layer disposed upon the product side of the metalized film enables a hermetic seal to be formed by the transverse sealing jaws at a temperature lower than the melt temperature of the film. Typical prior art sealant layers include an ethylene-propylene co-polymer and an ethylene-propylene-butene-1 ter-polymer. The metalized film layer, which is usually metalized with a thin layer of aluminum, provides excellent barrier properties.

Barrier properties in one or more layers are important in order to protect the product inside the package from light, oxygen or moisture. Such a need exists, for example, for the protection of foodstuffs, which may run the risk of flavor loss, staling, or spoilage if insufficient barrier properties are present to prevent transmission of such things as light, oxygen, or moisture into the package.

Adjacent to the metalized inside layer is a laminate layer, typically a polyethylene extrusion, and an outer ink or graphics layer. The ink layer is typically used for the presentation of graphics that can be viewed through a transparent outside layer, which layer is typically OPP or PET. The overall film thickness of this prior art film composition is typically less than 225 gauge. Such prior art film composition is well known in the art and disclosed in the discussion related to FIG. 1 in U.S. Pat. No. 7,189,300, which is hereby incorporated by reference.

The prior art film composition discussed above is ideally suited for use on vertical form and fill machines for the packaging of food products. The use of OPP or PET for the outside layer and the inside layer further makes it possible to heat seal any surface of the film to any other surface in forming either the transverse seals or back seal of a package.

Ideally, every seal on every package would be hermetic, or leak-proof, even under pressure changes. Without a hermetic seal, any barrier properties provided by the film are ineffective against oxygen, moisture, or aroma transmission between the product in the package and the outside. Hermetic seals are especially important with snack foods, so that flavor and freshness are preserved. Areas where the package has a back seal, folds, or gussets provide extra layers of material in the seal, but this problem becomes more acute with thicker packaging materials, additional folds in the package design, and smaller packages.

One problem with pillow-pouch packages is that they have a narrow, single-edge base made from the bottom transverse seal and therefore such prior art packages are not stable and are unable to stand independently (e.g., without leaning on something) on the bottom transverse seal. It would be desirable to have a pillow-pouch package capable of independently standing on its bottom-transverse seal.

FIGS. 1*a*-1*d* depict a vertical, stand-up pouch 100 having a front 102 defined by a top-transverse seal 120 and a bottom-transverse seal 130. Also depicted is a side 110 with a sealed gusset 112 adjacent to the bottom transverse seal 130 and an open gusset 114 adjacent the top transverse seal 120. A gusset is created on the side 110 of a package when four layers of film are captured because of film being pushed or folded inward and sealed together by the transverse sealing jaws when the transverse seal is made. It is not necessary that the transverse seals actually seal all four layers of packaging film together to form a gusset, as demonstrated by the open gusset 114. However, sealing all four layers together can result in a closed gusset 112.

Referring to FIGS. 1*c* and 1*d*, four layers of film are also sealed together in the vicinity of the middle of the rear face 106 of the package in the areas indicated by 127 137 if a fin seal is used as the back seal 140. Because such overlapping film is not on the side of the package and is not a result of being pushed inward or folded inward, such areas are not considered a gusset for purposes of this application.

As used herein, a "gusset" is defined as a gusset on the side 110 of a package and includes both open gussets 114 and closed gussets 112.

As shown, the front of the package 102 and the rear-package face 106 are bounded on the sides by heat-sealed creases 104 that run from the top transverse seal 120 to the bottom transverse seal 130. The package depicted in FIGS. 1*a*-1*d* is similar to the package disclosed in U.S. Pat. No. 5,398,486. The package depicted in FIGS. 1*a*-1*d* is constructed in a method similar to that described above with regard to prior art pillow-pouches. However, to form the side gussets 110 on either side of the bag, the vertical, form, fill and seal machine must be substantially modified by the addition of two moveable devices on opposite sides of the sealing carriage that move in and out to make contact with the packaging film to form the tuck that becomes the side 110 shown in FIGS. 1*a*-1*d*. Further, instead of using a single back-sealer to make a back seal 140, the package made in FIGS. 1*a*-1*d* require an additional heat sealing device for each crease 104 that is made in the package to provide additional stability to the package. Consequently, a total of five vertical sealing devices are used. Methods for making such vertical creases 104 are described and taught in U.S. Pat. Nos. 5,862,652 and 3,785,112.

As discussed above, it is important that the transverse seals on every package made from this film be a hermetic or leak-proof, transverse seal. This is especially important with low moisture shelf-stable foods and/or other products that are susceptible to oxygen and/or moisture.

FIG. 1*d* is a top perspective rear view of the prior art package depicted in FIG. 1*a* and illustrates the relative position and portion of the problem areas 125 126 127 of the transverse seal 120. FIG. 1*e* is an exaggerated top cross-sectional view of the problem area 125 of the package depicted in FIG. 1*d*. Referring to FIGS. 1*d* and 1*e*, regions 121 and 123 of the top transverse seal 120 each have four film layers that must be sealed together while region 122 has only two layers except at the intersection of the back seal. Similarly, if a lap seal is used to make the back seal 140 the area 127 will have three layers of packaging film and if a fin seal is used, the area 127 will have four layers of packaging film. Because of the change in the number of layers of packaging film, triangularly-shaped capillary leaks, pin-hole leaks, or void spaces 150 (as depicted by FIG. 1*e*) can occur in packages when side gussets 110 are made in the packaging film. Similar void spaces occur in each problem area as shown by numerals 125 126 127. FIG. 1*c* depicts locations where these problem areas 135 136 137 can occur on the bottom, transverse seal 130. The problem areas can occur in packages having an open gusset 114 as shown by the top portion of the package in FIG. 1*d* or in packages having a closed gusset 112 as shown the problem areas 135 136 137 illustrated by the bottom portion of the package in FIG. 1*c*.

The prior art solutions to overcoming pinhole leaks requires the film from prior art pillow packages to be modified in some manner. For example, while the top and bottom transverse seals 120 130 have the potential of having a problem areas 127 137, as depicted by FIGS. 1*c* and 1*d*, such problem areas can be addressed by use of the film disclosed in U.S. Patent Application Publication No. 2007/0128386, assigned to the same Assignee as the present invention.

Unfortunately, such prior art solution still requires film modification may not adequately address the problem areas 125 126 135 136 that can facilitate oxygen and moisture penetration into a package via the capillary void space 150 as depicted in FIG. 1*e*.

Another prior art solution for overcoming pinhole leaks is to add two or three times more sealant to the product facing layer, such as the product facing OPP layer. Another solution to overcoming such shortcoming is to use an additional film layer to try to fill up the capillary void space. The additional film layer is typically a 1 to 2.5 mil (100 to 250 gauge) linear low density polyethylene that must be laminated to the inner metalized OPP layer. Consequently, such films typically require a tandem lamination to make the requisite multi-layer film and substantially more film material must be used than is required for a standard pillow pouch package. The thickness of a film typically used for packages having gussets is usually greater than 300 gauge, which is at least about 33% more film than used in standard pillow pouch packages.

For example, U.S. Pat. No. 7,122,234 teaches that laminates used to make such packages require sufficient bending stiffness to be suitable for continuous high speed packaging. The '234 Patent teaches that sufficient stiffness occurs when the laminate thickness exceeds 110 micrometers or 433 gauge units (1 micron or micrometer=3.937 gauge; 100 gauge=1 mil=0.001 inches). European Patent Application 1 283 179 discloses a microwave heatable food product package associated with the trade name TETRAWEDGE. When measured, the TETRAWEDGE package revealed a thickness of 12.5 mil or 1250 gauge. One apparent consequence of using such thick material is that a crease pattern is applied to the packaging material prior to package formation to permit the material to be folded along inclined lateral corners and along base corners. Similarly, U.S. Pat. No. 5,508,075 discloses the need for crease lines to be stamped or otherwise impressed into the surface of the packaging material. It would be desirable to make a flat bottom pillow pouch using the same film as is used with prior art pillow packages without compromising the hermetic sealing properties of the transverse seal.

In one aspect, the package should be made to avoid open or closed gussets and to minimize the problem areas at an upper or lower transverse seal that occurs because of a change in the number of layers and regions of transition that can create capillary void spaces 150 in the transverse seals. In one aspect, the package should have three or more distinct edges defining the package bottom to permit the package to stand upright on the bottom transverse seal. In one aspect, the package should be made of the same film material and utilize the same film thickness used to make standard pillow pouch packages. In one aspect, the package is made with a film material without the need for crease lines to be stamped or otherwise impressed into the package film.

SUMMARY OF THE INVENTION

The present invention in one embodiment is directed towards a method of making a flat bottom pillow pouch comprising the steps of forming a bottom transverse seal, using an extension to form a package bottom with defined edges and flaps, folding the transverse seal, and folding the flaps beneath the package. In one embodiment, the present invention is directed towards a flat bottom pillow pouch having no gussets wherein the pouch stands on the bottom transverse seal. In one embodiment, the present invention is directed towards an improved vertical form fill and seal machine comprising an extendable and retractable extension below a product tube, a folding device for folding a transverse seal, and at least two side folding members to fold flaps formed by the extension in the extended position.

Other aspects, embodiments and features of the invention will become apparent from the following detailed description of the invention when considered in conjunction with the accompanying drawings. The accompanying figures are schematic and are not intended to be drawn to scale. In the figures, each identical, or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention. All patent applications and patents incorporated herein by reference are incorporated by reference in their entirety. In case of conflict, the present specification, including definitions, will control.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1B:
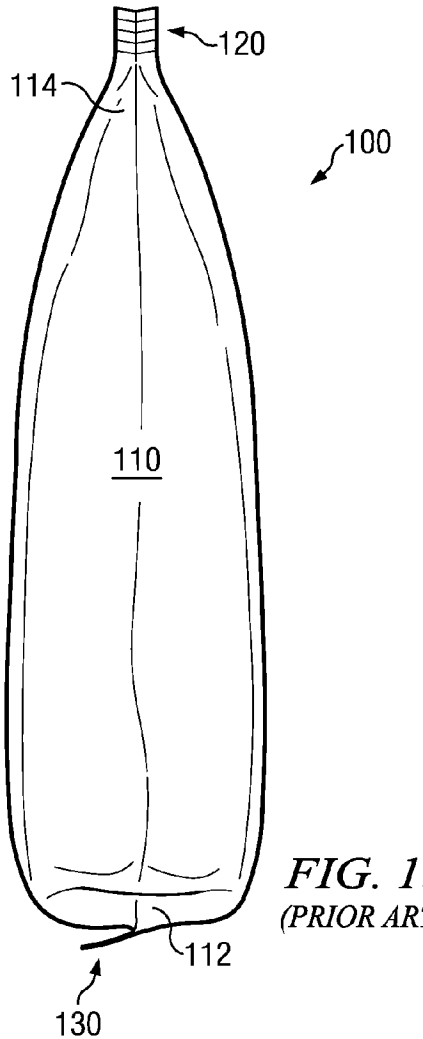
FIG. 1b (PRIOR ART)
FIG. 1*b* is a side view of the prior art package depicted in FIG. 1*a*.
Figure 1A:
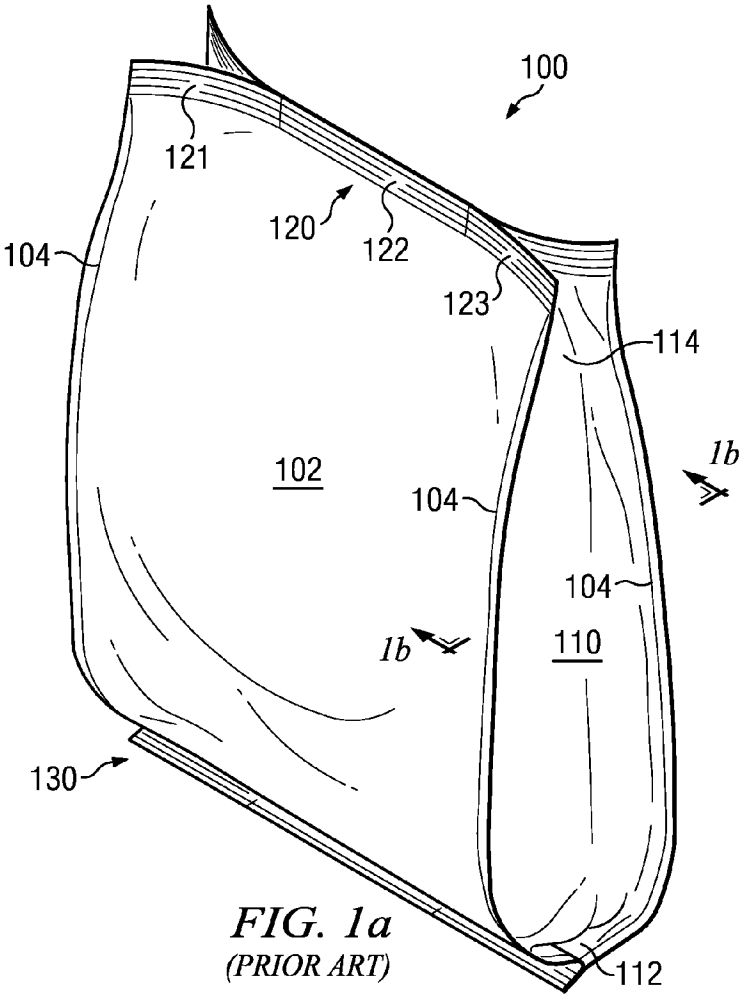
FIG. 1a (PRIOR ART)
FIG. 1*a* is a front perspective view of a prior art package that stands on the bottom transverse seal.
Figure 1D:
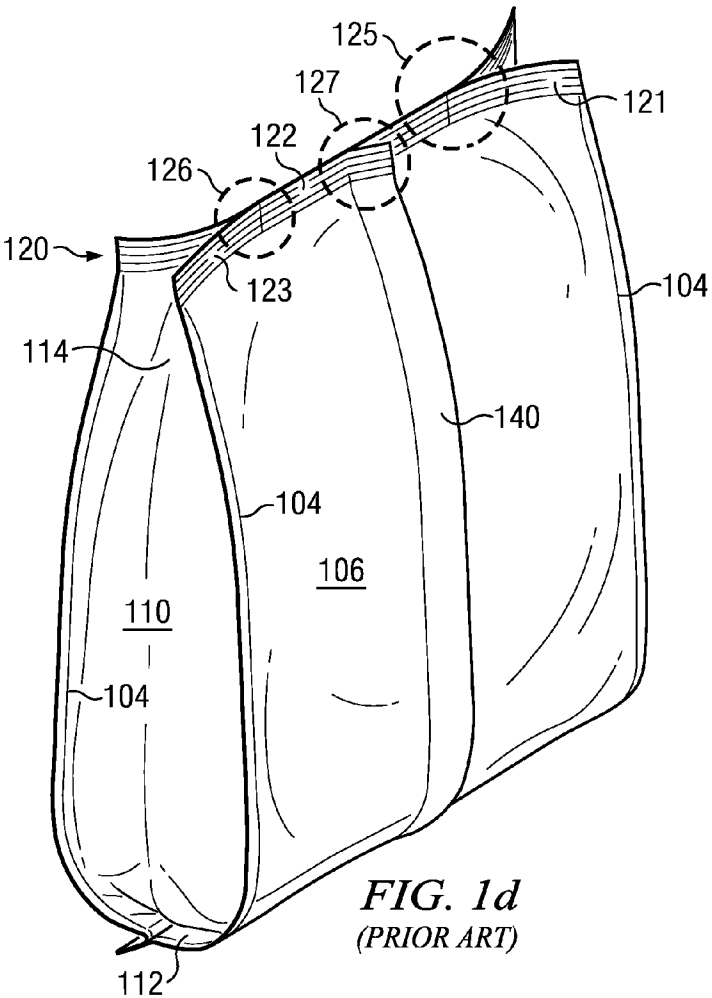
FIG. 1d (PRIOR ART)
FIG. 1*d* is a top rear perspective view of the prior art package depicted in FIG. 1*a*.
Figure 1C:
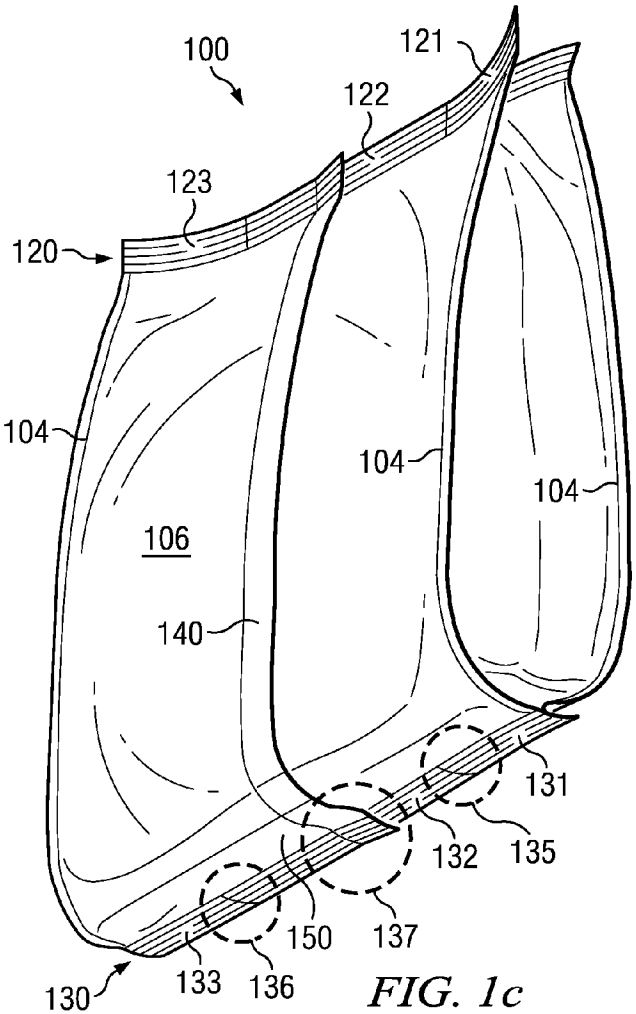
FIG. 1c (PRIOR ART)
FIG. 1*c* is a bottom rear perspective view of the prior art package depicted in FIG. 1*a*.
Figure 1E:
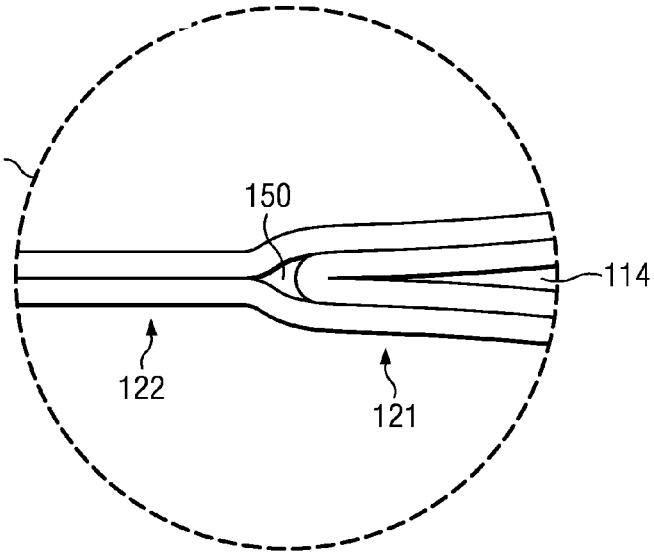
FIG. 1e (PRIOR ART)
FIG. 1*e* is a top cross-sectional view of a portion of the package depicted in FIG. 1*d*.
Figure 2A:
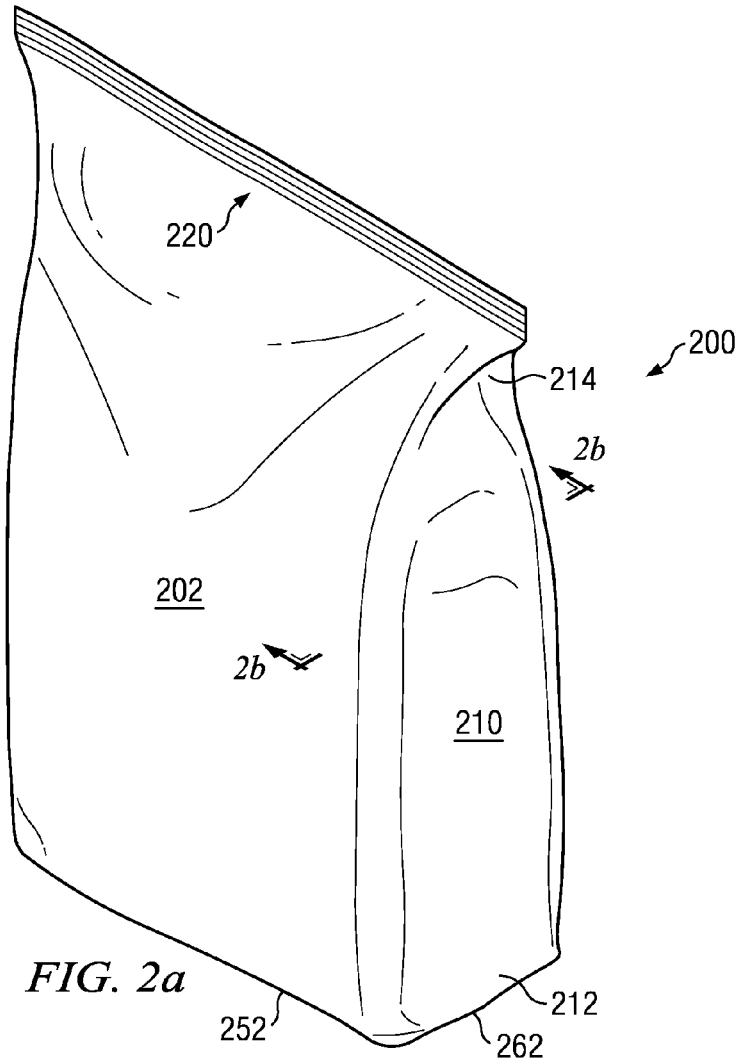
FIG. 2*a* is a front perspective view of a flat bottom pillow pouch made in accordance with one embodiment of the present invention.
Figure 2C:
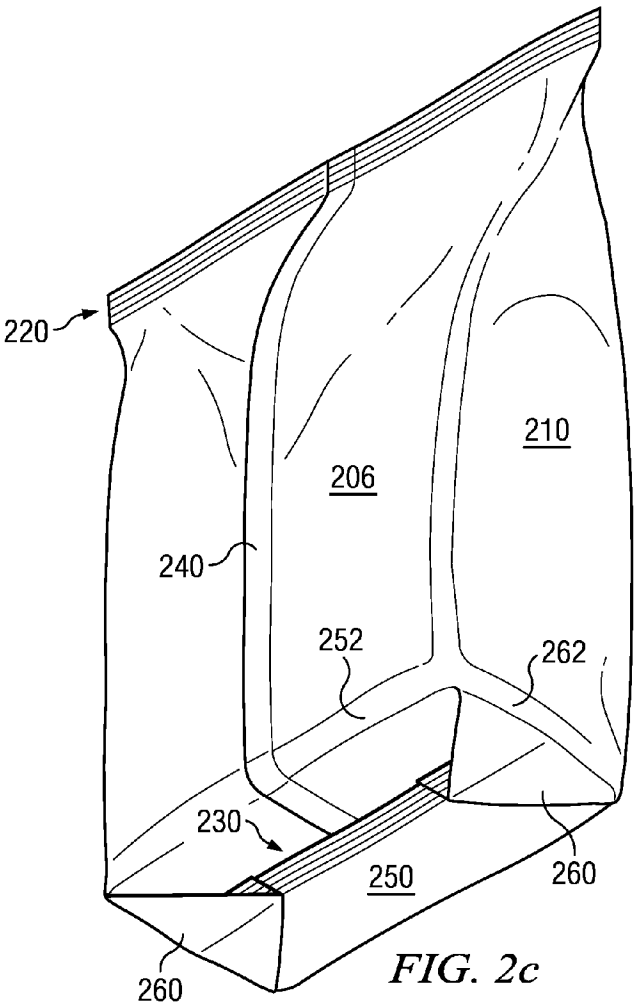
FIG. 2*c* is a rear bottom-perspective view of the package depicted in FIG. 2*a*.
Figure 2B:
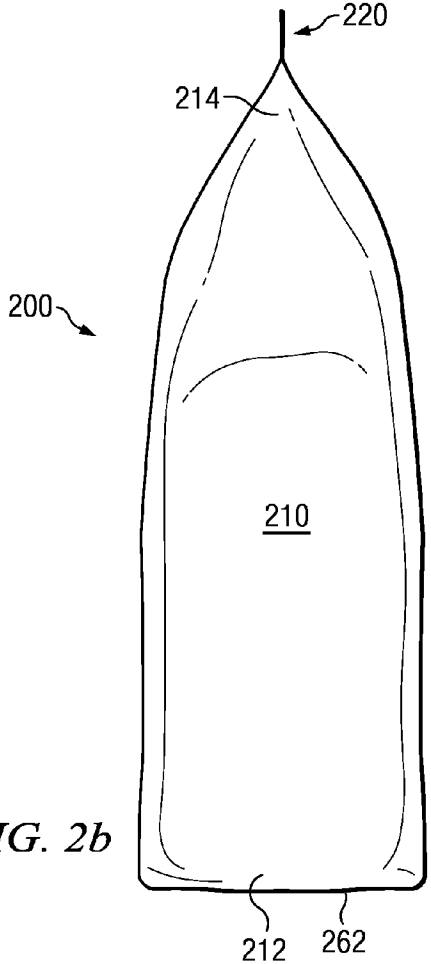
FIG. 2*b* is a side view of the package depicted in FIG. 2*a*.
Figure 2D:
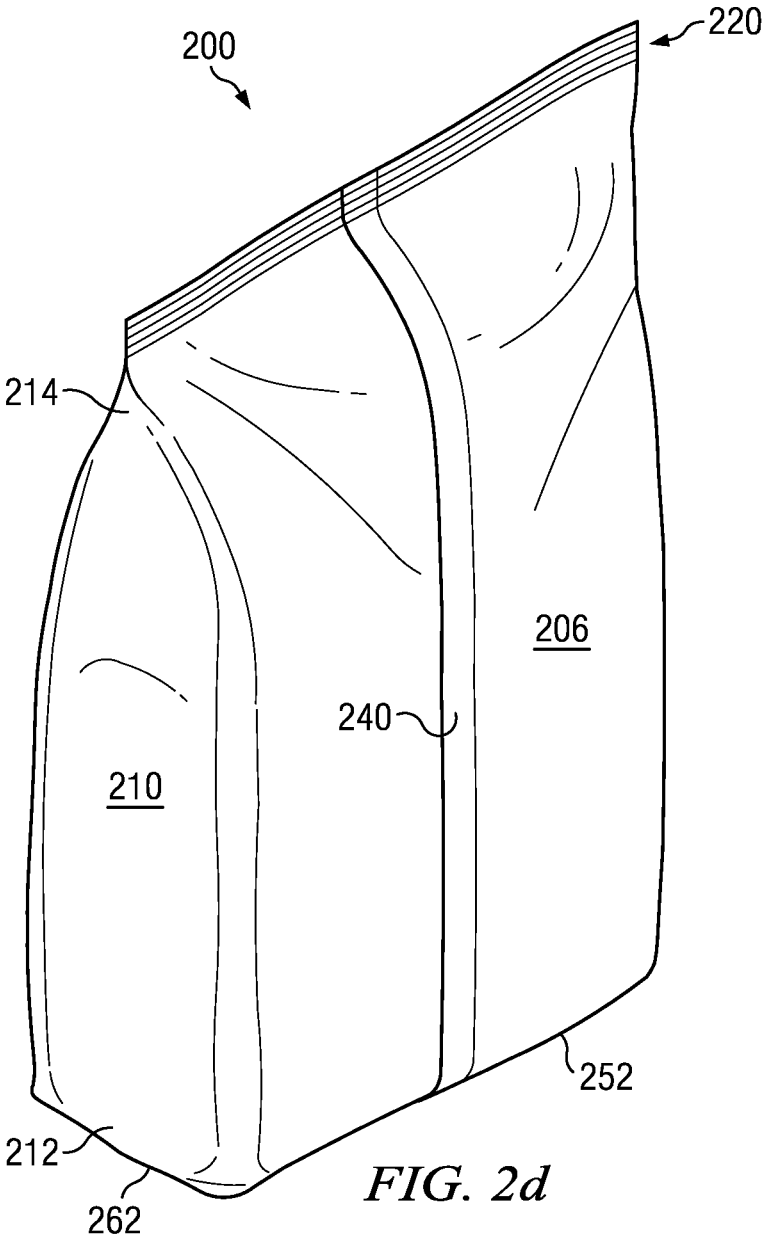
FIG. 2*d* is a top rear perspective-view of the package depicted in FIG. 2*a*.
Figure 3A:
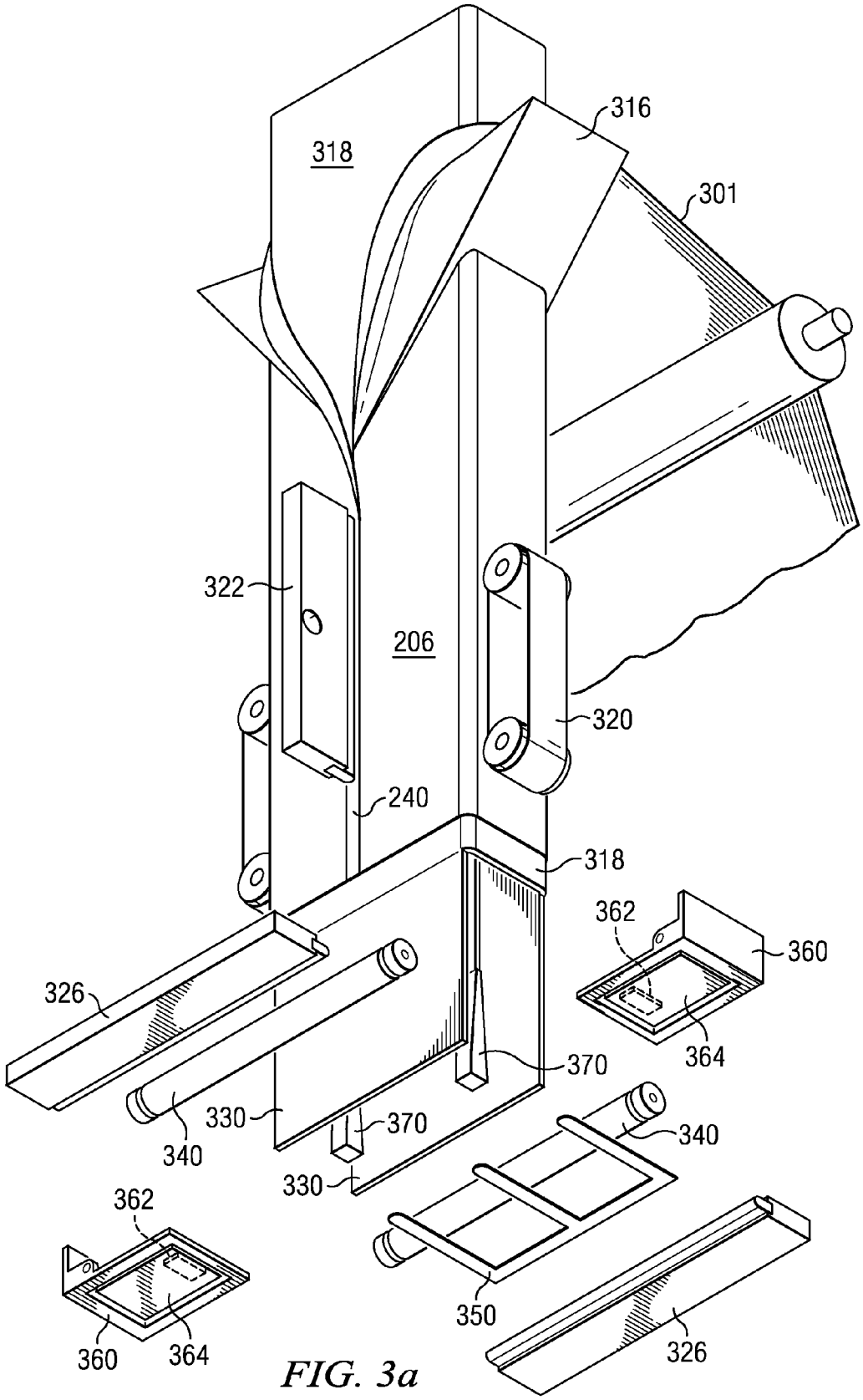
FIGS. 3*a*-3*g* are perspective views showing the sequence of operation of the formation of a package in accordance with one embodiment of the present invention.

FIG. 2*a* is a top front perspective view of a flat bottom pillow pouch package made in accordance with one embodiment of the present invention. FIG. 2*b* is a side view of the package depicted in FIG. 2*a*. FIG. 2*c* is a rear bottom-perspective view of the package depicted in FIG. 2*a*. FIG. 2*d* is a top rear perspective-view of the package depicted in FIG. 2*a*. Referring to FIGS. 2*a*-2*d*, in one embodiment, the present invention comprises a flat-bottom, pillow-pouch bag or package 200 having no pleats or gussets along the side of a package. Rather the package of the present invention, in one embodiment comprises a side 210 between the front face 202 and the rear face 206, that tapers upwardly from the bottom portion 212 adjacent the bottom edge 262 upwardly to the top transverse seal 220. Consequently, the area 214 near the top transverse seal 220 of the present invention is much like the area near the top transverse seal of a prior art pillow-pouch bag as depicted by FIG. 3a of U.S. Pat. No. 6,722,106 because both packages have no gussets adjacent to the top transverse seal as clearly shown by FIGS. 2*a*-2*d*.

Referring to FIG. 2*c*, the package of the present invention comprises a pair of inwardly-folded ears 260 that are positioned beneath the package bottom 250. FIG. 2*c* further depicts the bottom transverse seal 230 oriented as substantially perpendicular to the top transverse seal 220. In one embodiment, a portion of the bottom transverse seal 230 on the inwardly folded ears 260 is heat sealed to the bottom 250. The package bottom 250 as depicted is substantially rectangular in shape. In one embodiment, the periphery of the package bottom 250 comprises a substantially perpendicular front and rear edge 252 such that the bottom 250 is substantially perpendicular to the front 202 and rear 206. In one embodiment, the periphery of the package bottom 250 comprises a substantially perpendicular side edge 262 such that the bottom 250 is substantially perpendicular to the side 210. Those skilled in the art will recognize that the front 202, rear 206, and sides 210 will be slightly less than perpendicular to the bottom 250 because of the tapering of the sides 210 of the package from bottom to top.

FIGS. 3*a*-3*g* are perspective views showing the sequence of operation of the formation of a package on an improved vertical form fill and seal machine in accordance with one embodiment of the present invention. For purposes of simplification, the top portion of the vertical form fill and seal machine has been omitted from FIGS. 3*b*-3*g*. Flexible packaging film 301 having barrier properties is taken from a roll of film (not shown) and passed over a former 316 which directs the film into a vertical tube around a product delivery tube 318, as depicted in FIG. 3*a*. As used herein, flexible packaging film having barrier properties is defined as flexible film having an oxygen transmission rate of less than about 150 cc/m$^2$/day (ASTM D1434) and a water vapor transmission rate of less than about 5 grams/m$^2$/day (ASTM F372-99).

Figure 5A:
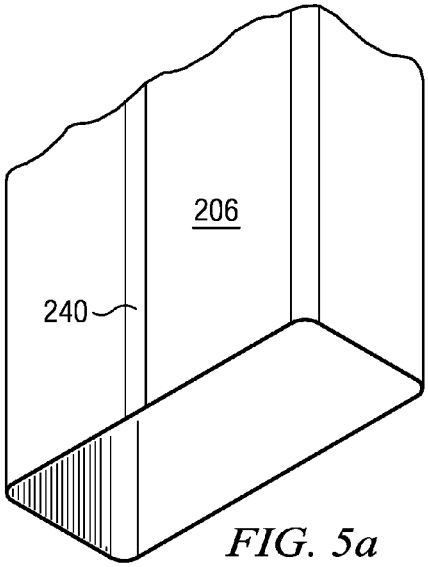
FIGS. 5*a*-5*d* are perspective views showing the sequence of operation of the formation of the packaging film in accordance with one embodiment of the present invention.

FIGS. 5*a*-5*d* are perspective views showing the sequence of operation of the formation of the packaging film in accordance with one embodiment of the present invention. The formation of the package shown in FIGS. 2*a*-2*d* will now be described with reference to FIGS. 3*a*-3*g* and FIGS. 5*a*-5*d*. As shown by FIGS. 3*a* and 5*a*, while the tube is pulled downward by drive belts 320, the vertical tube of film is sealed along its length by a vertical sealer 322, forming a back-seal 240. As shown in FIG. 3*a*, the product delivery tube 318 comprises an extension 330 beneath the product delivery tube 318. In the embodiment shown the extension 330 comprises a pair of flaps in the extended position. As used herein, the extended position refers to an extension 330 that is oriented in a manner which creates outward tension on the film tube upon completion of the bottom transverse seal 230. In the embodiment shown, the extended position occurs when the extension 330 is parallel to the portion of the product delivery tube 318 to which the extension 330 is attached.

Figure 3B:
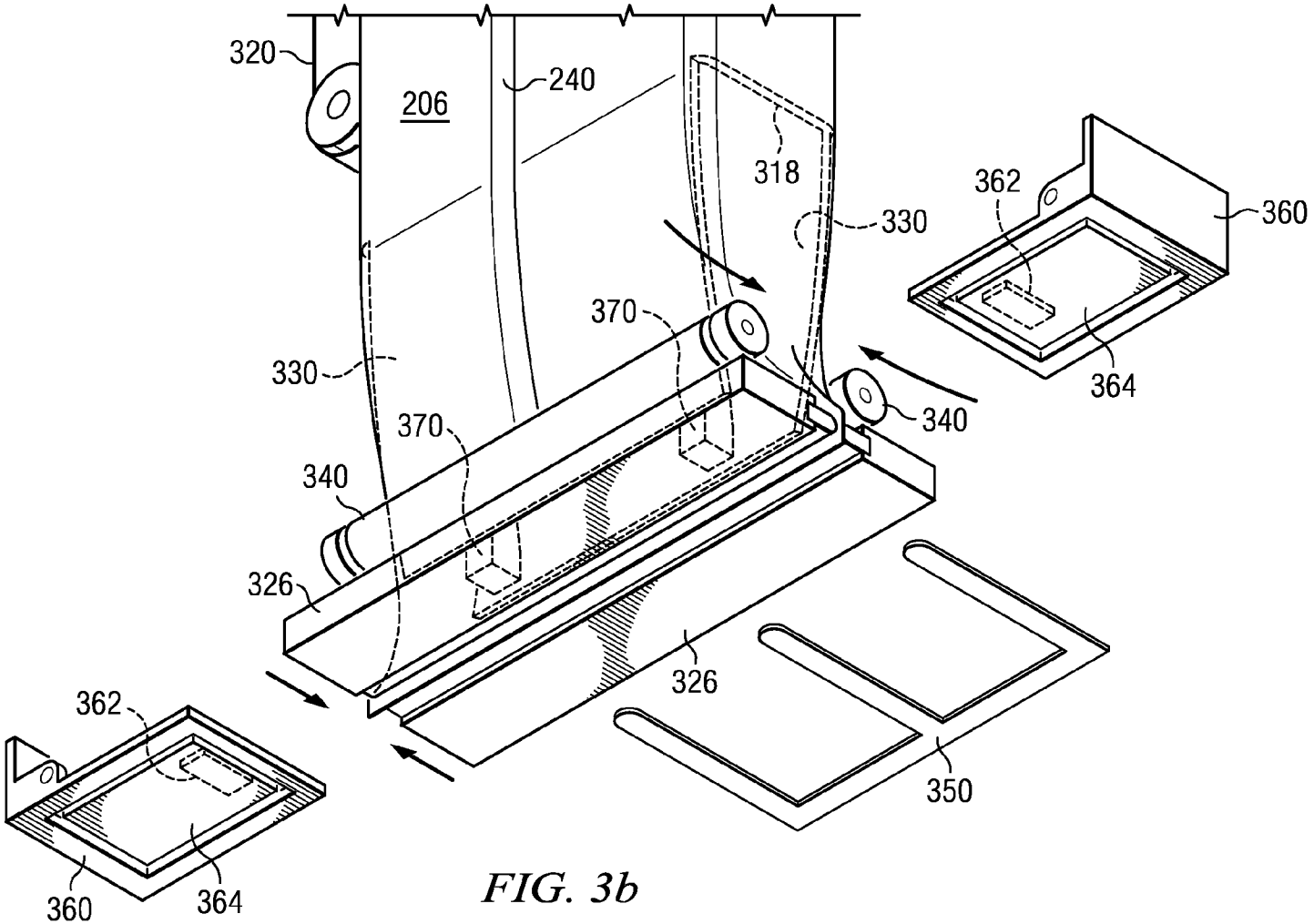
Figure 5B:
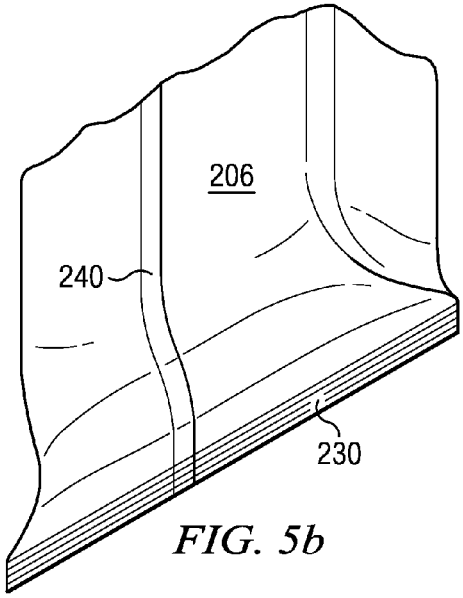

Referring to FIGS. 3*b* and 5*b*, the sheet of film 301 is pulled downward below the product delivery tube 318. The bottom end seal 230 is made with a pair of sealing jaws 326 beneath the product delivery tube 318 having an extension 330 in the retracted position to form an open-ended tube. As used herein, the retracted position refers to an extension 330 position that permits a bottom transverse end seal to be made beneath the product delivery tube 318 with a pair of sealing jaws 326. The flexible flaps comprising the extension 330 shown in FIG. 3*b* can be made of 0.035 inches of spring steel or any suitable flexible material. Such embodiment advantageously permits the flexible flaps to flex inwardly into a retracted position via actuation of a closing mechanism 340 to permit the sealing jaws 326 to close to form a transverse seal to minimize or eliminate the creation of tucks or pleats.

Figure 3C:
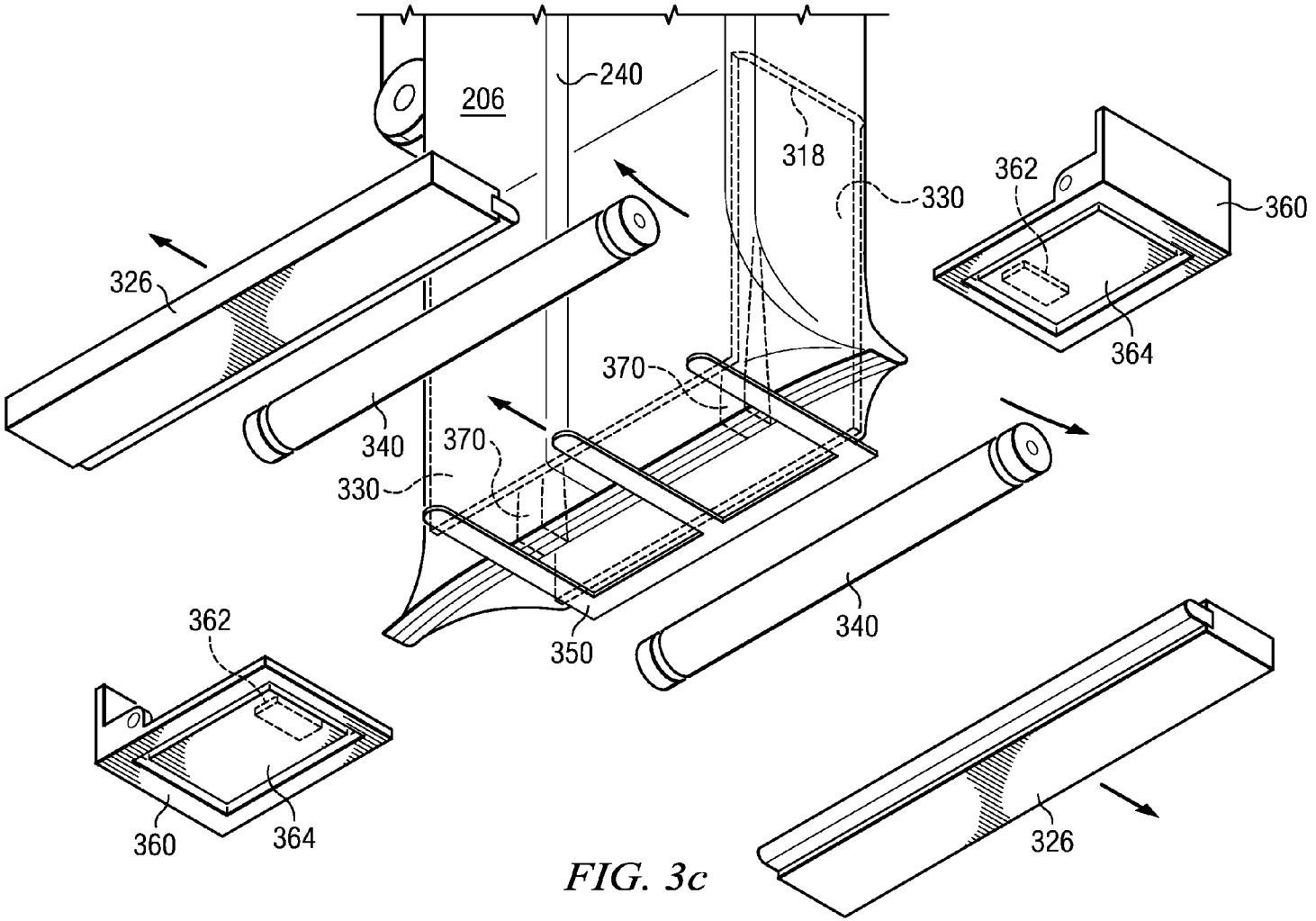
Figure 5C:
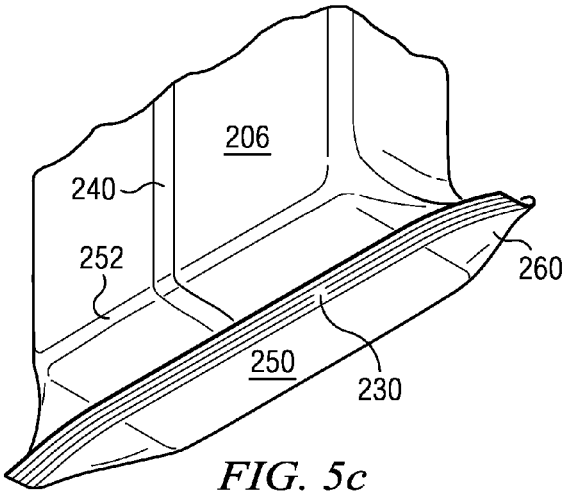

As shown by FIGS. 3*c* and 5*c*, upon completion of the bottom transverse seal, the closing mechanism 340 is released, and the flexible flaps 330 automatically flex back outwardly back into the extended position thereby defining the package bottom 250 having a pair of outwardly-extending flaps 260, as best shown by reference to FIG. 5*c*. The transverse seal 230 moves upward in elevation as the extension 330 moves into the extended position and as the package bottom 250 becomes defined. A folding device 350, at an elevation higher than the sealing jaws 326 can then be engaged beneath the extended extension 330 to fold the bottom transverse seal 230. In one embodiment, the residual heat imparted by the heat sealing jaws 326 on the bottom transverse seal causes the folded bottom transverse seal to stick to the bottom of the package when the folding device 350 has been engaged. In one embodiment, the folding device 350 comprises heated edges. After the folding device 350 has been engaged, the flaps 260 advantageously bend downward. Such bending of the flaps 260 can help ensure the side folding members 360 can engage the flaps 260 as discussed below. Product can be dropped through the product delivery tube 318 any time after the forks 350 have been engaged and the bottom seal 230 (as shown in FIG. 5*c*) has been folded over.

Figure 3D:
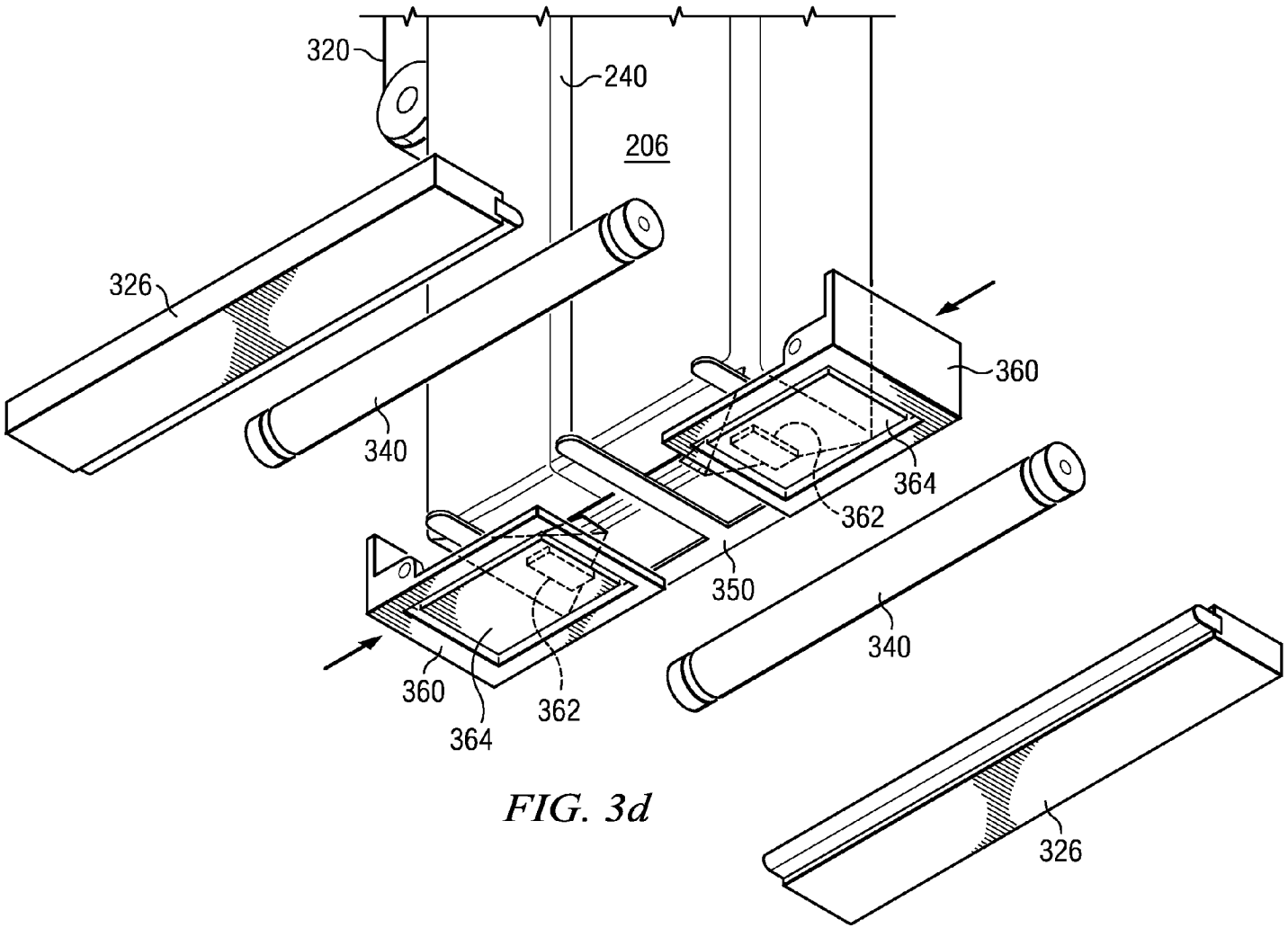
Figure 5D:
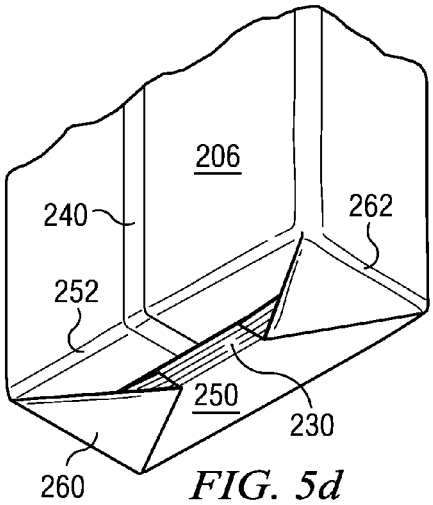

FIG. 3*d* depicts another step of the package formation in accordance with one embodiment of the present invention. The side folding members 360 are positioned in elevation such that the side folding members 360 are below the folding device 350 and above the terminal ends of the flaps 260. As shown in FIGS. 3*d* and 5*d*, a pair of side folding members 360 fold each of said flaps 260 inwardly and beneath the package bottom 250. In one embodiment, the folding device 350 remains beneath the package bottom 250 while the folding members 360 fold the flaps 260 beneath both the package bottom 250 and the folding device 350. In one embodiment, heat from the folding device 350 and/or the folding members 360 softens the outer film layers of the flaps 260 and the package bottom 250 which helps fuse and seal the flaps 260 to the package bottom 250. In one embodiment, the folding device 350 comprises a fork having at least two fingers. In one embodiment, the folding device 350 comprises a three-fingered fork which advantageously provides an open area for contact between the package bottom 250 and flaps 260 as shown in FIG. 3*d*. In one embodiment, because the bottom transverse seal 230 is still relatively hot from the heated sealing jaws 326, the bottom transverse seal on the flaps 260 is sealed via residual heat to the bottom transverse seal on the package bottom 250 in the open areas between the folding device 350 fingers. In one embodiment, a pedestal 370 (shown in FIG. 3*c*) is disposed below the product delivery tube 318 and inside the extension 330. In one embodiment, the pedestal 370 is substantially flush in elevation with the extension 330 when the extension 330 is in the extended position.

Figure 3E:
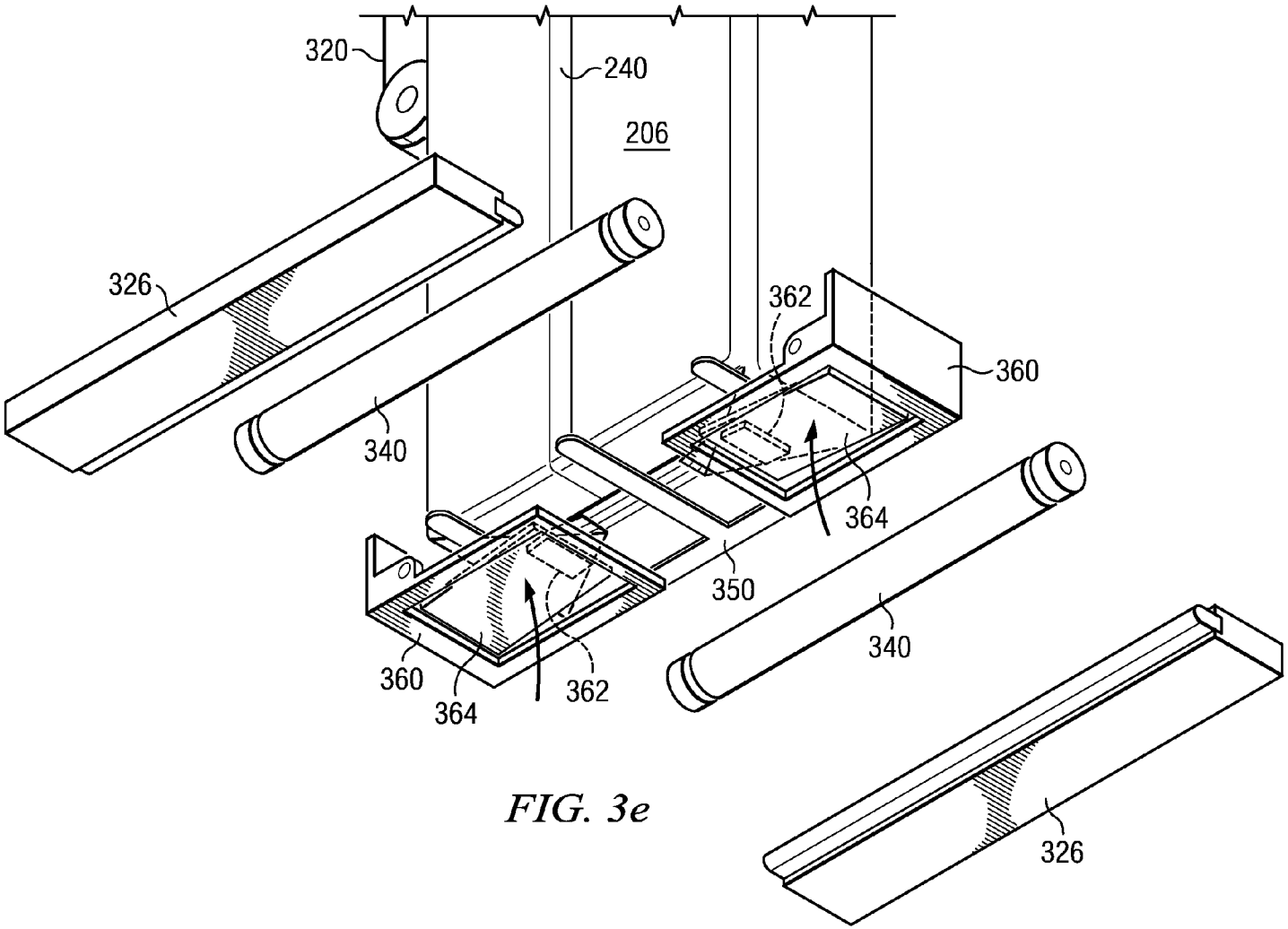

FIG. 3*e* is a bottom perspective view of the next sequential step in accordance with one embodiment of the present invention. As shown in FIG. 3*e*, the side folding member 360 comprises a mount 364 for a pivoting extension 362. After the side folding members 360 have folded the flaps 260 beneath the package bottom 250, a pivoting extension 362 placed on a mount 364 that is flush with each side folding member 360 is moved upward in the direction depicted by the arrows so as to engage the pedestal 370, the pedestal 370 being depicted in FIG. 3*c*. Consequently, referring to FIGS. 3*e* and 5*d*, the pivoting extensions 362 apply vertical pressure between the respective flaps 260 and the package bottom 250. The pedestal 370 (depicted in FIG. 3*c*) holds the package bottom in place 250 such that pressure is applied between the flaps 260 and the package bottom 250. In one embodiment, because the transverse seal 230 has residual heat from the heat sealing jaws, and because of the pressure applied by the pivoting extension 362 against the flaps and the pedestal 370, the portion of the transverse seal from the flaps 260 is sealed to the portion of the transverse seal on the package bottom 250. In one embodiment the side folding members 360 can be heated and in one embodiment the pivoting extension 362 and/or the pedestal 370 is heated to further facilitate the seal between the flaps 260 and the package bottom.

Figure 3F:
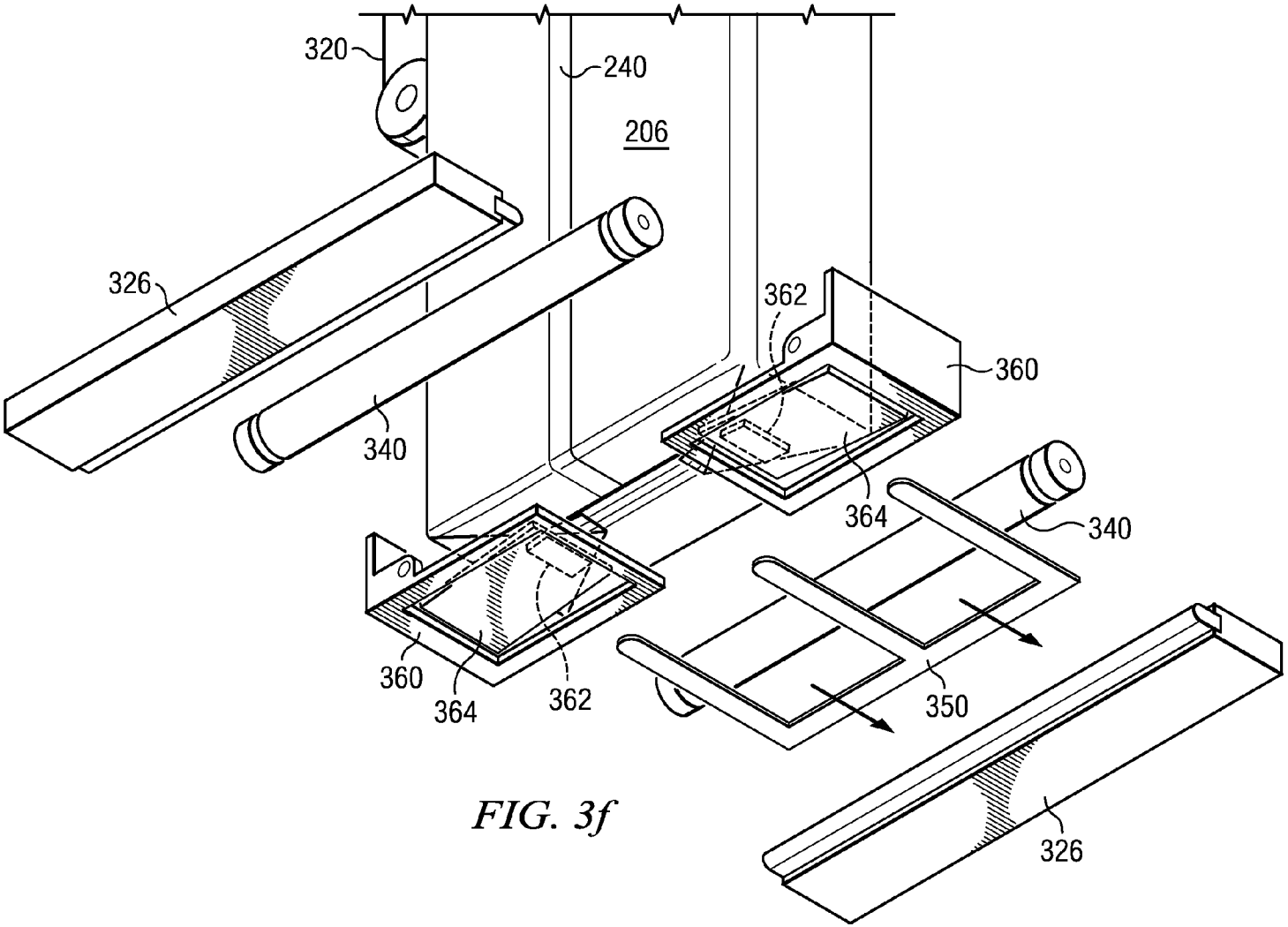

FIG. 3*f* is a bottom perspective view of the next sequential step in accordance with one embodiment of the present invention. Once the flaps 260 have been folded inwardly and optionally sealed to the package bottom 250, the folding device 350 can then be removed from beneath the package bottom 250.

Figure 3G:
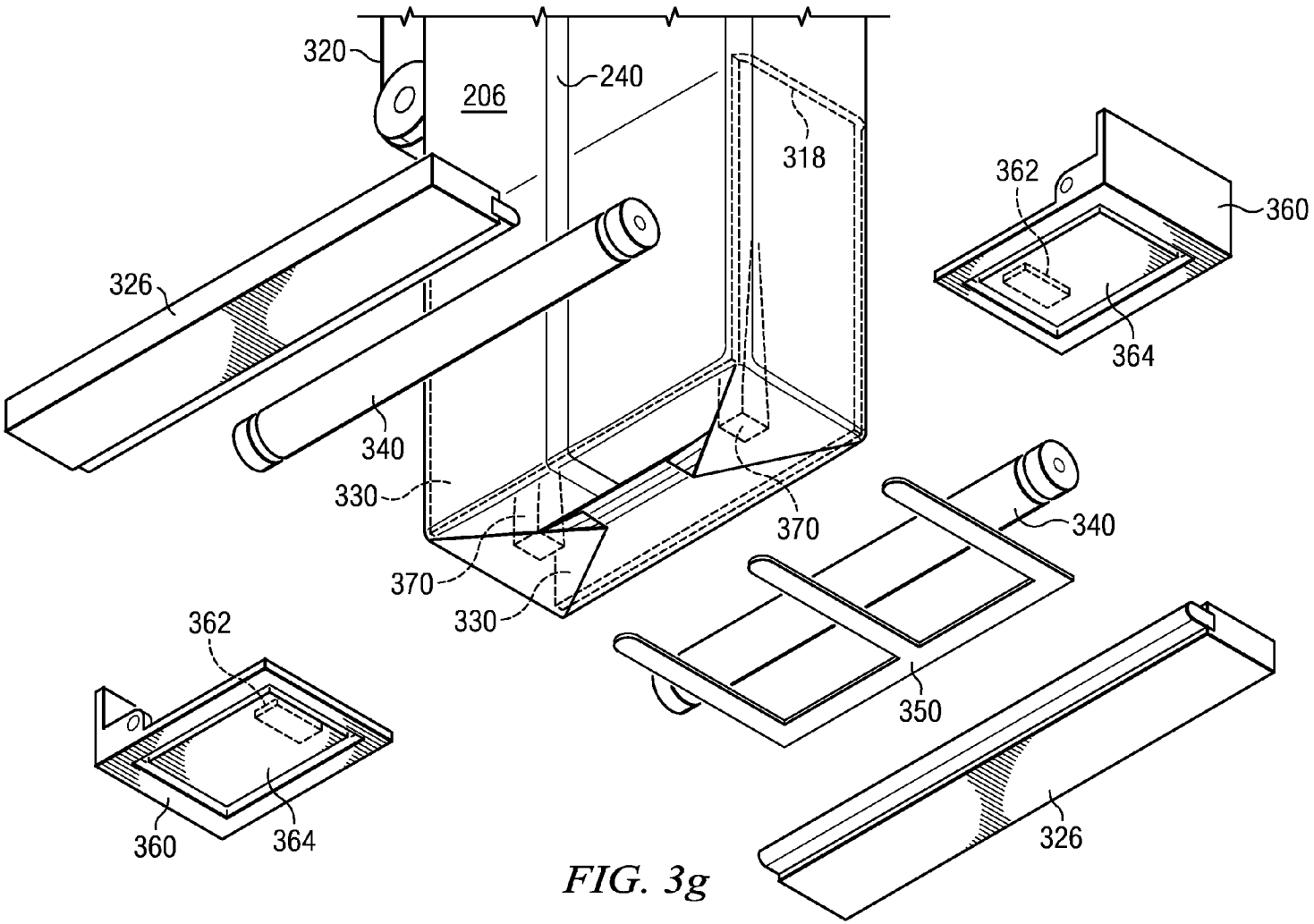

FIG. 3*g* is a bottom perspective view of one step of the present invention. As shown in FIG. 3*f*, the folding members 360 can then be moved outwardly from beneath the package bottom 250. The sheet of film can then be pulled downwardly prior to making the top transverse seal.

Figure 4A:
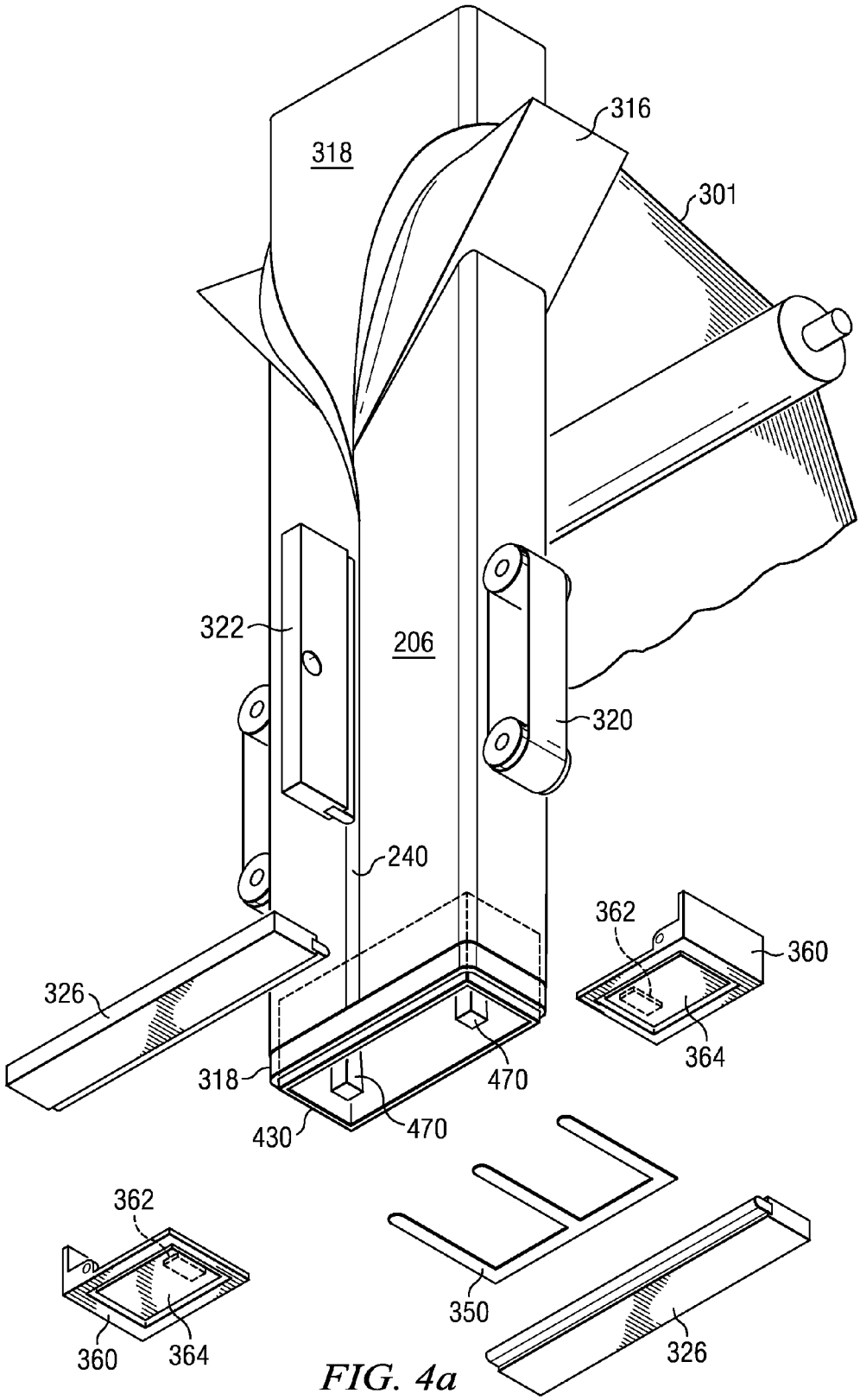
FIGS. 4*a*-4*g* are perspective views showing the sequence of operation of the formation of a package in accordance with one embodiment of the present invention.

FIGS. 4*a*-4*g* are perspective views showing the sequence of operation of the formation of a package on an improved vertical form fill and seal machine in accordance with one embodiment of the present invention. For purposes of simplification, the top portion of the vertical form fill and seal machine has been omitted from FIGS. 4*b*-4*g*. Flexible packaging film 301 having barrier properties is taken from a roll of film (not shown) and passed over a former 316 which directs the film into a vertical tube around a product delivery tube 318. While the tube is pulled downward by drive belts 320, the vertical tube of film is sealed along its length by a vertical sealer 322, forming a back-seal 240. As shown in FIG. 4*a*, the product delivery tube 318 comprises an extension 430 beneath the product delivery tube 318. In the embodiment shown in FIG. 4*a*-4*f*, the extension 430 comprises a telescoping extension that is slidably movable in the vertical direction between a retracted position and an extended position. The telescoping extension can be movably disposed within the product delivery tube 318 and the telescoping extension can be attached to a control cylinder via a pneumatically operated or other suitable rod assembly to move the telescoping extension as needed. Such telescoping extensions are known in the art as illustrated by U.S. Pat. No. 5,505,040, which is hereby incorporated by reference.

Figure 4B:
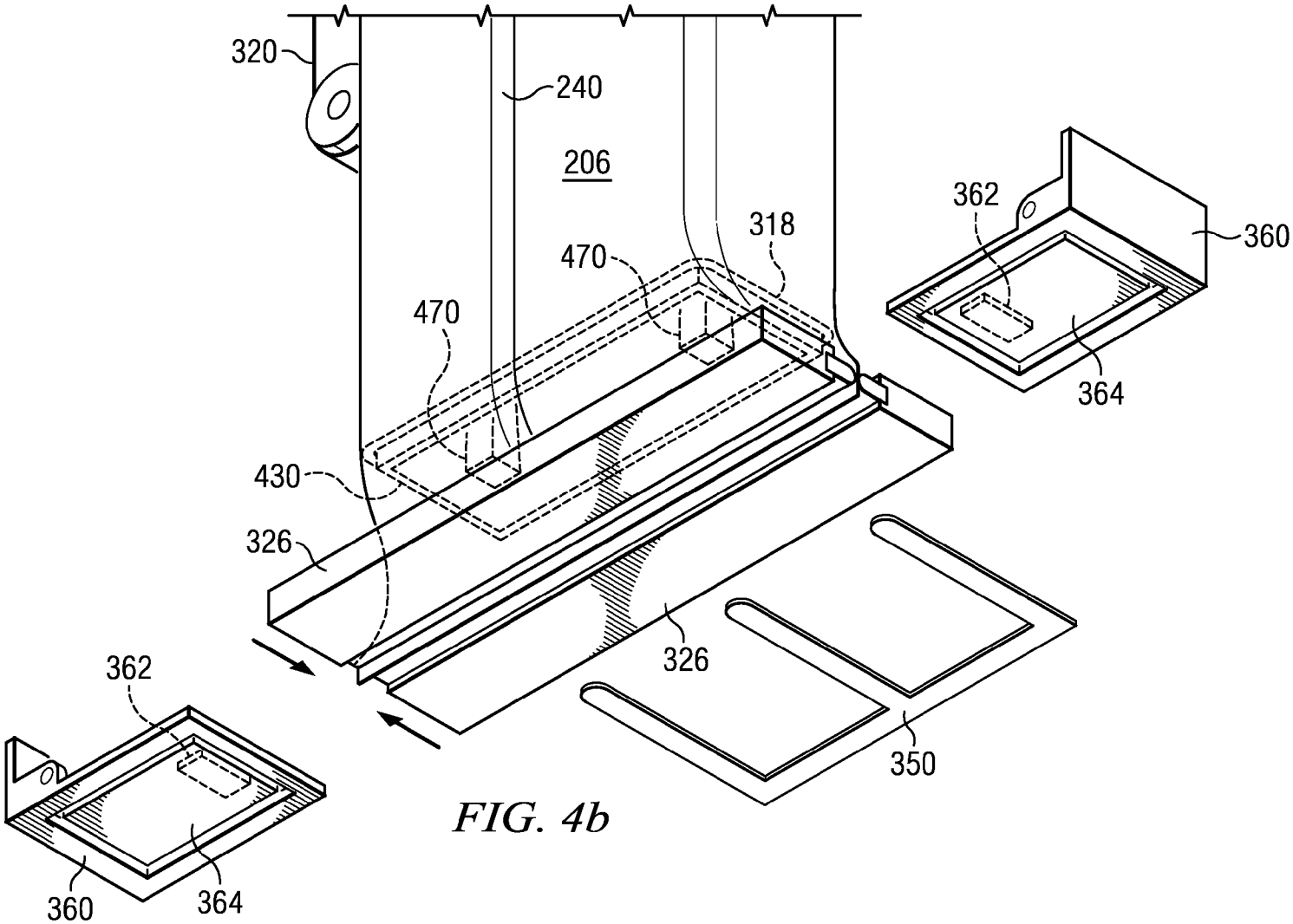

Referring to FIG. 4*b*, the sheet of film 301 is pulled downward below the product delivery tube 318. Referring to FIGS. 4*b* and 5*b*, the bottom end seal 230 is made with a pair of sealing jaws 326 beneath the product delivery tube 318 having an extension 430 in the retracted position.

Figure 4C:
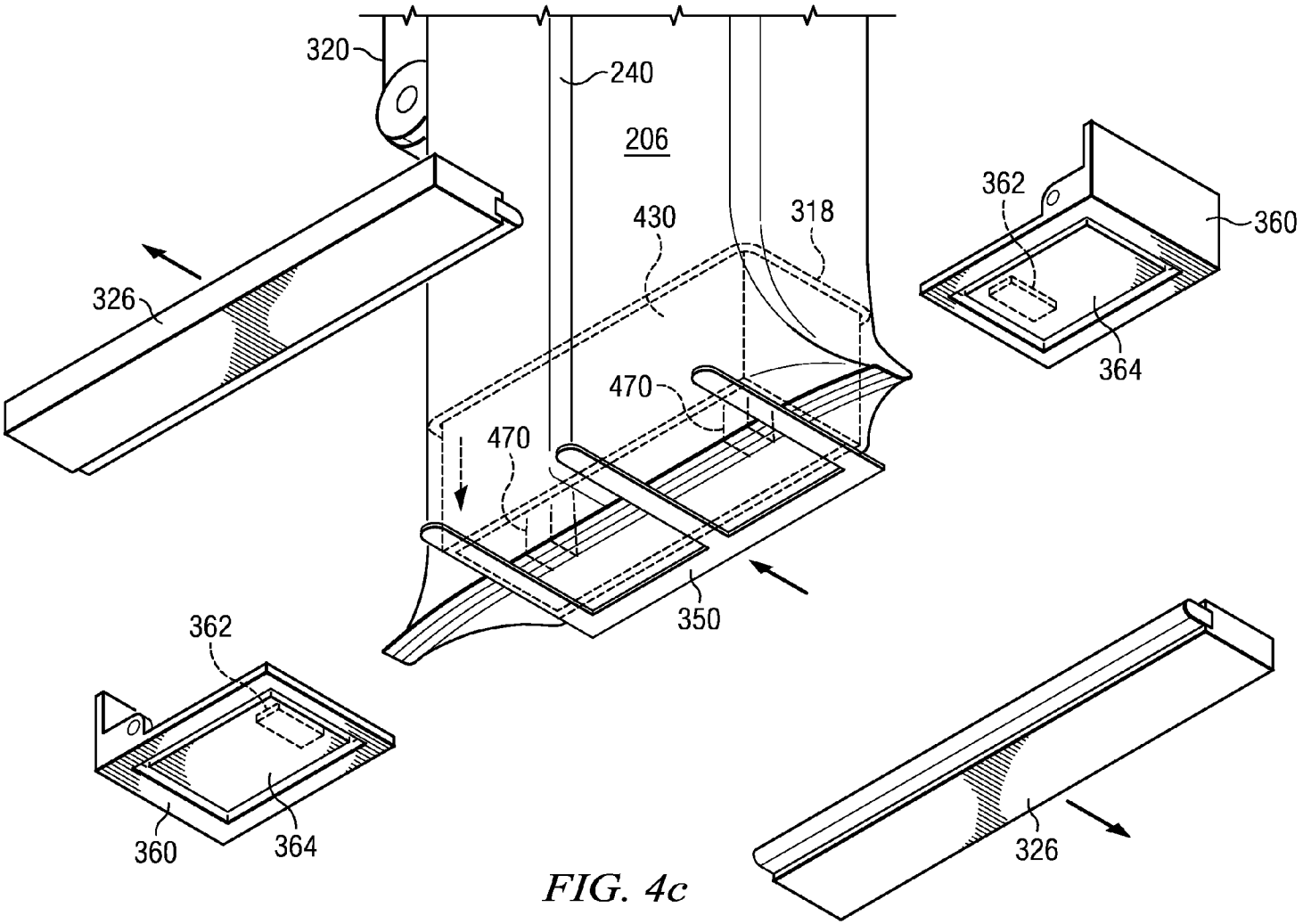

As shown by FIGS. 4*c* and 5*c*, upon completion of the bottom transverse seal 230, the extension 430 is slid into an extended position thereby forming the package bottom 250 having a pair of outwardly-extending flaps 260, as best shown by reference to FIG. 5*c*. The transverse seal 230 moves upward in elevation as the extension moves into the extended position and as the package bottom 250 becomes defined.

A folding device 350 at an elevation higher than the sealing jaws 326 can then be engaged beneath the extended extension 430 to fold the bottom transverse seal 230. In one embodiment, the residual heat on the bottom transverse seal from the heat sealing jaws 326 causes the folded bottom transverse to stick to the bottom of the package when the folding device 350 has been engaged. In one embodiment, the folding device 350 comprises heated edges. After the folding device 350 has been engaged, the flaps 260 advantageously bend downward. Such bending of the flaps 260 can help ensure the side folding members 360 can engage the flaps 260 as discussed below. Product can be dropped through the product delivery tube 318 any time after the forks 350 have been engaged and the bottom seal (as shown in FIG. 5*c*) has been folded over.

Figure 4D:
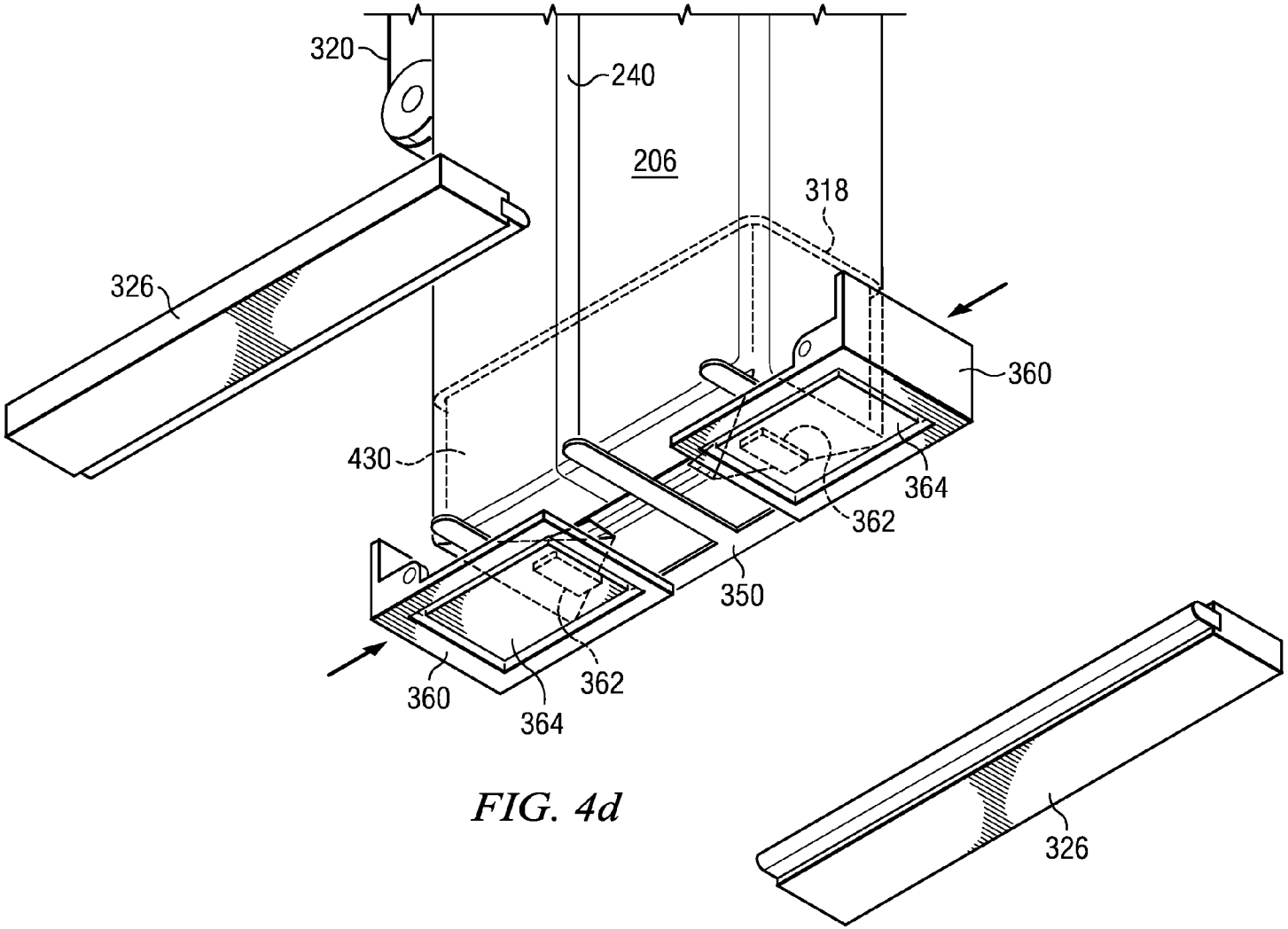

FIG. 4*d* depicts another step of the package formation in accordance with one embodiment of the present invention. The side folding members 360 are positioned in elevation such that the side folding members 360 are below the folding device 350 and above the terminal ends of the flaps 260. As shown in FIGS. 4*d* and 5*d*, a pair of side folding members 360 fold each of said flaps 260 inwardly and beneath the package bottom 250. In one embodiment, the folding device 350 remains beneath the package bottom 250 while the side folding members 360 fold the flaps beneath both the package bottom 250 and the folding device 350. In one embodiment, heat from the folding device 350 and/or the folding members 360 softens the outer film layers of the flaps 260 and the package bottom 250 which helps fuse and seal the flaps 260 to the package bottom 250. In one embodiment, the folding device 350 comprises a fork having at least two fingers. In one embodiment, the folding device 350 comprises a three-fingered fork which advantageously provides an open area for contact between the package bottom 250 and flaps 260 as shown in FIG. 4*d*. In one embodiment, because the bottom transverse seal 230 is still relatively hot from the heated sealing jaws 326, the bottom transverse seal on the flaps 260 is sealed via residual heat to the bottom transverse seal on the package bottom 250 in the open areas between the folding device 350 fingers. In one embodiment, a pedestal 470 (shown in FIG. 4*c*) is disposed below the product delivery tube 318 and inside the extension 430. In one embodiment, the pedestal 470 is substantially flush in elevation with the bottom end of the extension 430 when the extension 430 is in the extended position. The pedestal 470 can be attached to and move with the telescoping extension 430.

Figure 4E:
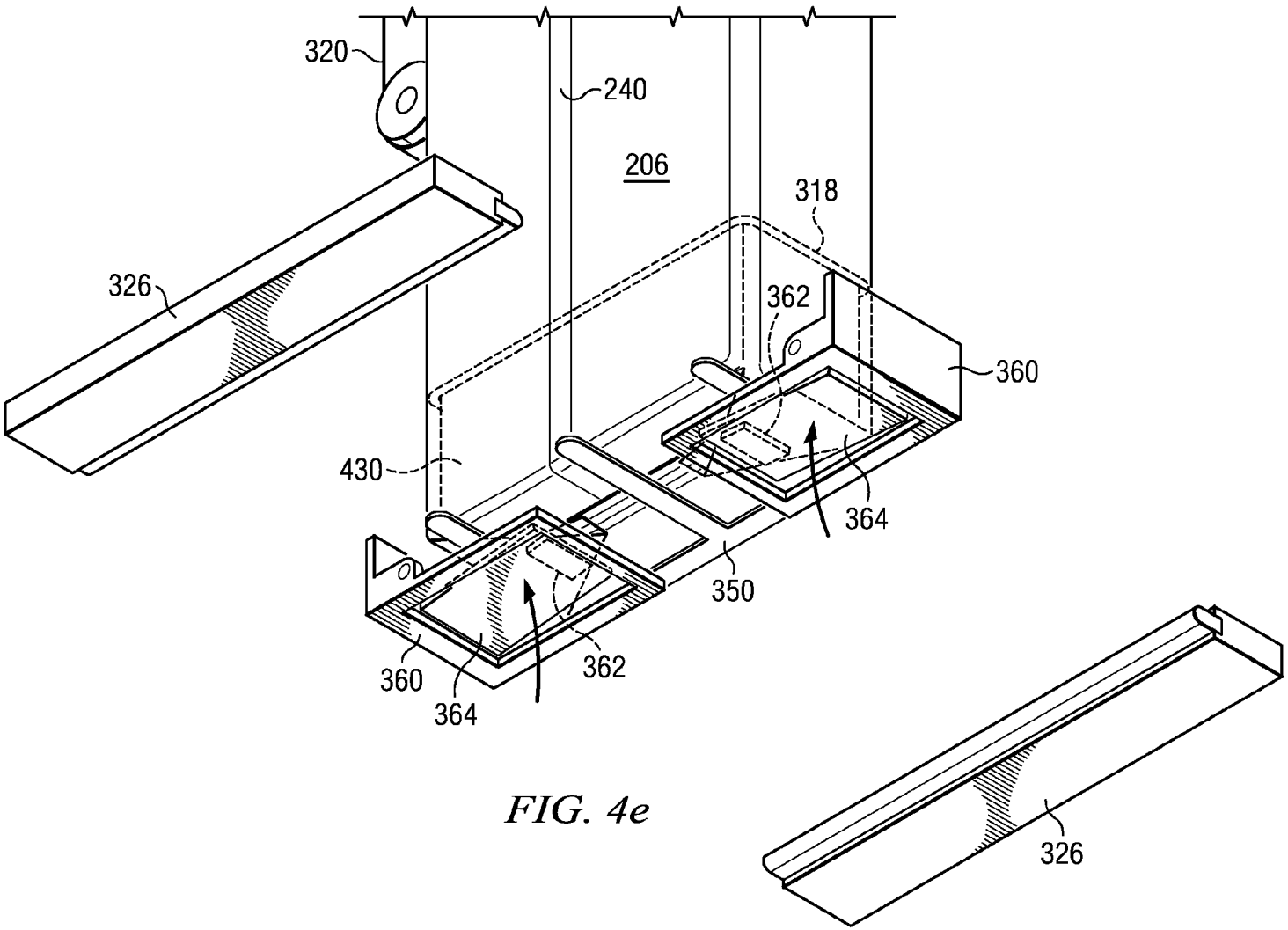

FIG. 4*e* is a bottom perspective view of the next sequential step in accordance with one embodiment of the present invention. As shown in FIG. 4*e*, the side folding member 360 comprises a mount 364 for a pivoting extension 362 After the side folding members 360 have folded the flaps 260 beneath the package bottom 250, a pivoting extension 362 placed on a mount 364 that is flush with each side folding member 360 is moved upward in the direction depicted by the arrows so as to engage the pedestal 470, the pedestal 470 being depicted in FIG. 4*c*. Consequently, referring to FIGS. 4*e* and 5*d*, the pivoting extensions 362 apply pressure between the respective flaps 260 and the package bottom 250. The pedestal 470 (depicted in FIG. 4*c*) holds the package bottom in place 250 such that pressure is applied between the flaps 260 and the package bottom 250. In one embodiment, because the transverse seal 230 has residual heat from the heat sealing jaws, and because of the pressure applied by the pivoting extension 362 against the flaps and the pedestal 470, the portion of the transverse seal from the flaps 260 is sealed to the portion of the transverse seal on the package bottom 250. In one embodiment the side folding members 360 can be heated and in one embodiment the pivoting extension 362 and/or the pedestal 470 is heated to further facilitate the seal between the flaps 260 and the package bottom.

Figure 4F:
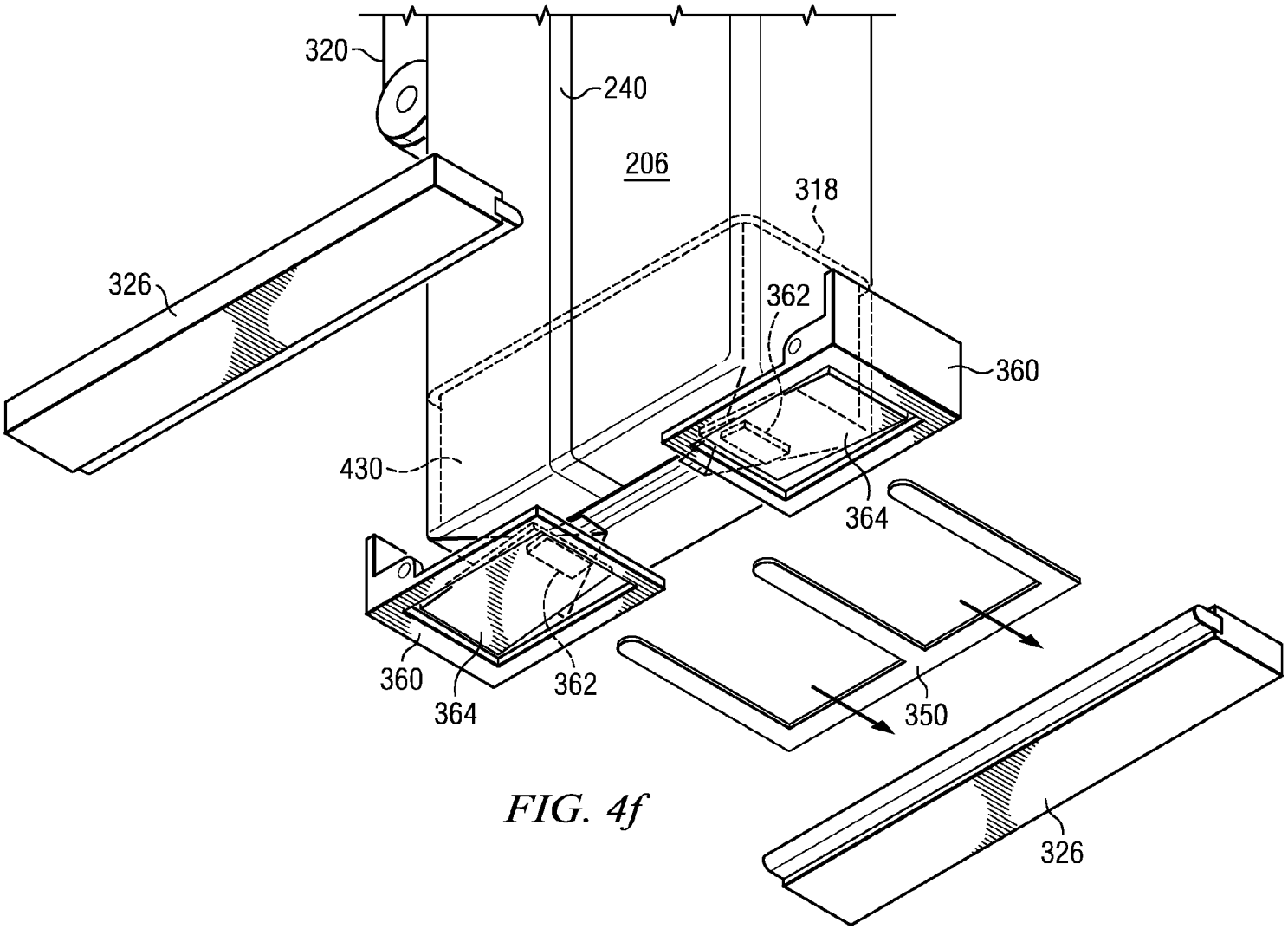

FIG. 4*f* is a bottom perspective view of the next sequential step in accordance with one embodiment of the present invention. Once the flaps 250 have been folded inwardly and optionally sealed to the package bottom 250, the folding device 350 can then be removed from beneath the package bottom 250.

Figure 4G:
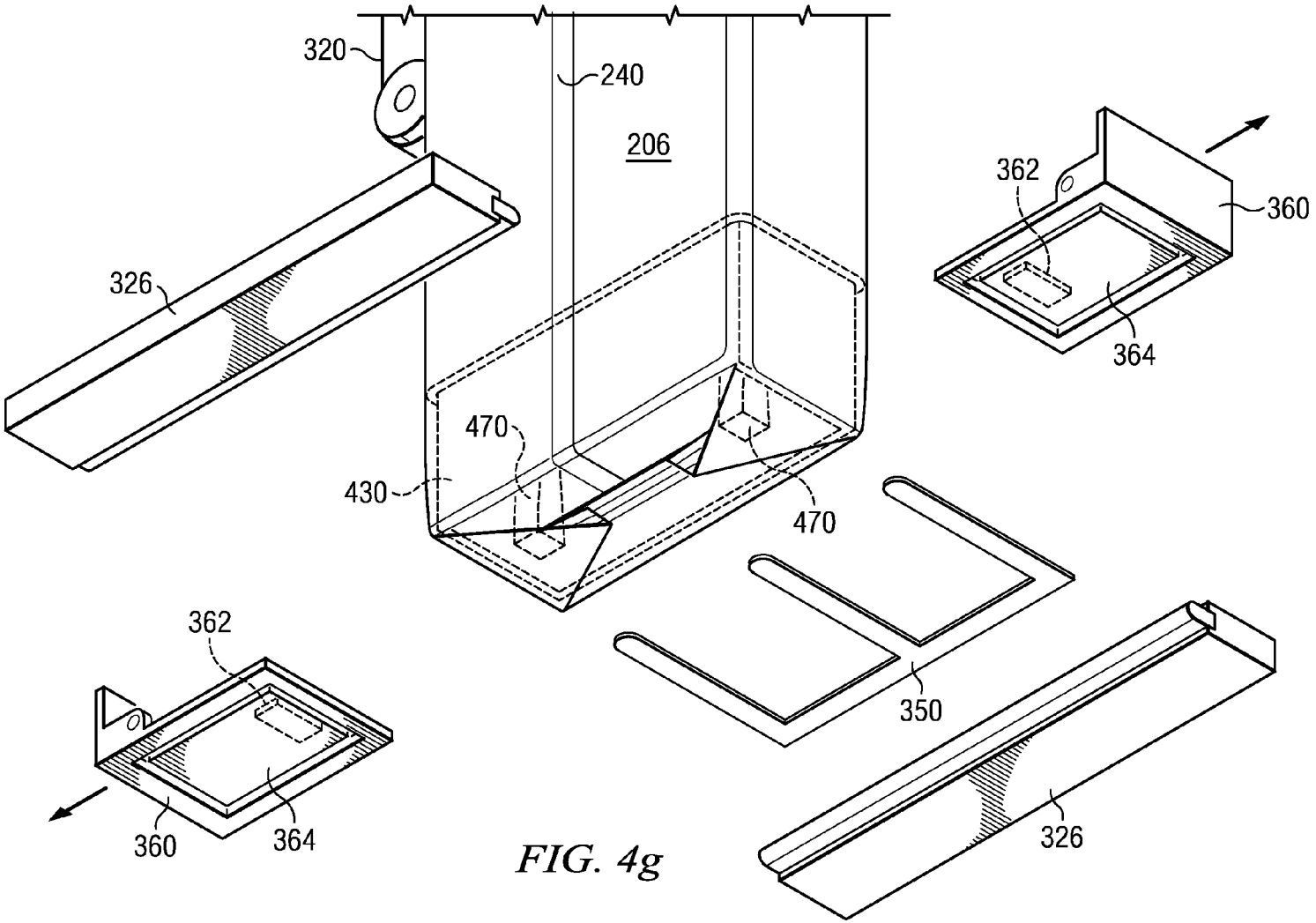

FIG. 4*g* is a bottom perspective view of one step of the present invention. As shown in FIG. 4*f*, the folding members can then be moved outwardly from beneath the package bottom 250. The sheet of film can then be pulled downwardly where the top, transverse seal is made.

FIGS. 5*a*-5*d* are partial simplified rear perspective bottom views depicting the sequential method of how the bottom of the package depicted in FIG. 2*c* is made from the packaging film. The vertical form fill and seal equipment has been omitted. FIG. 5*a* represents the film tube having a back seal 240 and corresponds to the film tube depicted in FIGS. 3*a* and 4*a*. FIG. 5*b* represents the open ended film tube after the bottom transverse seal has been made and corresponds to the film tube depicted in FIGS. 3*b* and 4*b*. FIG. 5*c* depicts the package bottom 250 having a folded bottom transverse seal 230 and an edge 252 that is substantially perpendicular to the rear package face 204. FIG. 5*c* corresponds to the film tube depicted in FIGS. 3*c* and 4*c*. FIG. 5*d* depicts the completed package bottom 250 having a pair of inwardly-folded ears 260 positioned beneath the package bottom and corresponds to the package depicted in FIGS. 3*d* and 4*d*. To make the package of the present invention, a transverse seal is made on an open ended film tube as shown in FIG. 5*b*. Edges 252 are then formed to define a flat package bottom 250. Formation of the edges 252 creates a pair of flaps 260 as shown by FIG. 5*c*. The flaps 260 are then folded inwardly and beneath the package bottom 250 to create side edges 262.

An embodiment has been disclosed wherein the extension 330 comprises a pair of flaps. Another embodiment has been disclosed wherein the extension 330 comprises a telescoping extension. In yet another embodiment the extension 330 comprises two or more movable fingers which are movable between an extended position and a retracted position. In one embodiment the extension 330 comprises two pair of movable fingers.

Figure 6A:
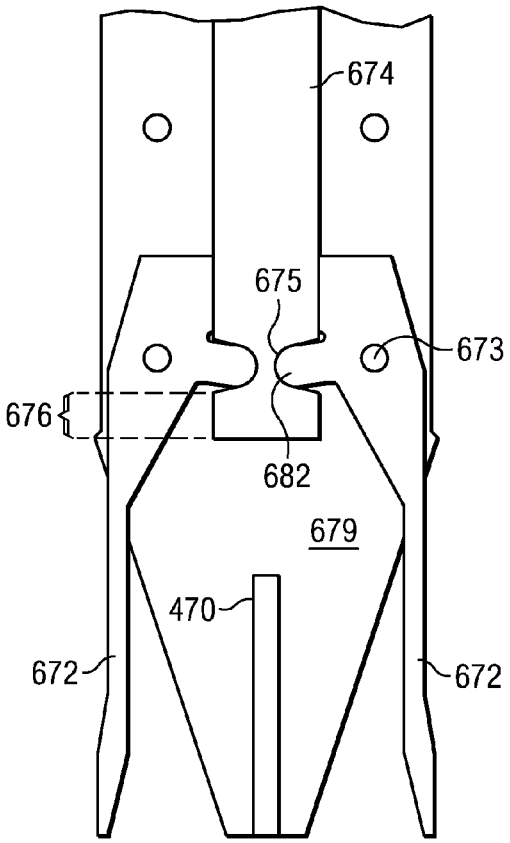
FIG. 6*a* is a side view showing the drive system in an extended position in one embodiment.

In one embodiment the movable fingers are a part of a vertical drive system. As used herein a vertical drive system is a system which converts a vertical force into either a rotational or horizontal force. FIG. 6*a* is a side view showing the drive system in an extended position in one embodiment. As depicted the vertical drive system comprises a lever 674 which is laterally movable relative to a base 679. In one embodiment the base 679 is stationary.

Coupled to the base 679 is at least one pair of fingers 672. In one embodiment, as depicted, the fingers 672 comprise a needle-like shape. Such a shape allows the fingers 672 to extend within, and define, the corners of a package. In other embodiments the fingers 672 comprise a planar flap which moveable between an extended position and a retracted position. Virtually any shape which can be converted from an extended position, in which the fingers direct opposing forces, to a retracted position can be utilized. For example, in one embodiment comprising fingers the fingers define four points in space. These points define the footprint of the bottom of the bag. Virtually any shape which provides for these points in space which define the bottom of the bag can be utilized.

As depicted the fingers 672 and the base 679 are coupled via pivots 673. The pivots 673 can comprise rivets, screws, bolts, or any such device which allows the fingers 672 to rotate. As depicted there is only one pivot 673 per finger 672. In other embodiments more than one pivot 673 can be used per finger 672. The pivots 673 enable the fingers 672 to rotate relative to the base 679.

As depicted the lever 674 comprises two notches 675. The notches 675 are sized to receive a handle 682 located on the fingers 672. The notches 675 and handles 682 are so sized so that if the lever 674 is pulled in the upward direction, the handle 682 can move accordingly within the notch 675. While the lever 674 is shown as having a notch 675, in other embodiments the lever 674 comprises a handle 682 whereas the fingers 672 comprise the notch 675. Other devices which rotatably couple the fingers 672 to the lever 674 can also be suitably used. For example, in one embodiment the notch 675 and handle 682 comprises a ball and socket. Likewise, the notch and handle can comprise many different shapes. Different shapes will affect the maneuverability of the handle 682 within the notch 675.

As noted, FIG. 6*a* shows the fingers in an extended position. In one embodiment the fingers 672 are substantially parallel with the sides of the product delivery tube 318. As can be seen, the fingers 672 are maintained in their position by the lever 674; the top of the fingers 672 butt up against the lever 674 preventing the fingers 672 from further extending. For example, the level 674 prevents the finger 672 on the right side of FIG. 6*a* from rotating in the counter-clockwise direction. If, however, an upward force is applied to the lever 674 both fingers 672 will rotate to a retracted position.

Figure 6B:
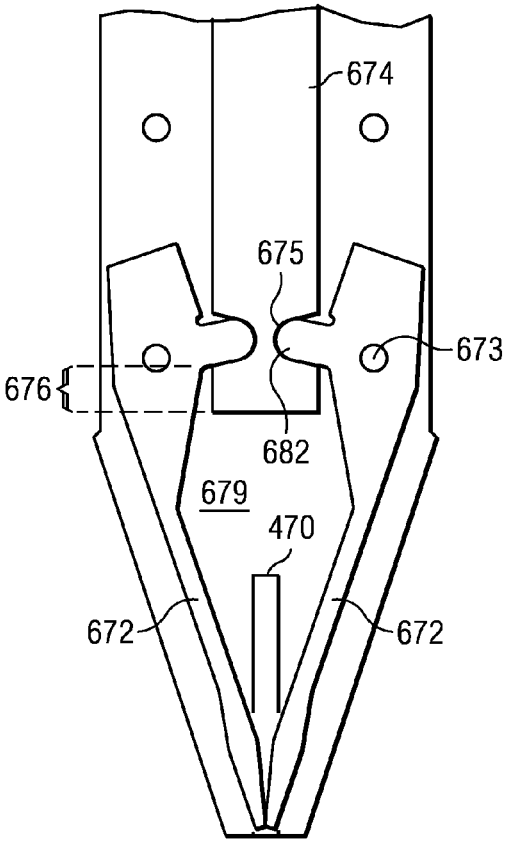
FIG. 6*b* is a side view showing the drive system in a retracted position in one embodiment.

FIG. 6*b* is a side view showing the drive system in a retracted position in one embodiment. As can be seen, now the fingers 672 butt against the low end 676 of the lever 674. The low end 676 prevents the fingers 672 from further retracting. For example, the low end 676 prevents the finger 672 on the right side of FIG. 6*b* from rotating in the clockwise direction. If, however, a downward force is applied to the lever 674 then both fingers 672 will rotate to the extended position. It can be seen that the base 679 comprises a wedge shape at the bottom end. In one embodiment the wedge shape mimics the shape of the fingers 672 in the retracted position. The wedge can be wider or narrower than the fingers 672 in the retracted position. One benefit from this wedge shape is that it prevents the wedge from rubbing or otherwise interfering with the film. As such, having a wedge which is narrower than the fingers 672 in the retracted position prevents the wedge from contacting, and possibly damaging, the film.

As described, the position of the fingers 672 can be adjusted by lateral movement of the lever 674. The lateral movement of the lever 674 can be controlled by any means known in the art including, but not limited to, actuators which apply a force upon a lever 674.

Figure 7A:
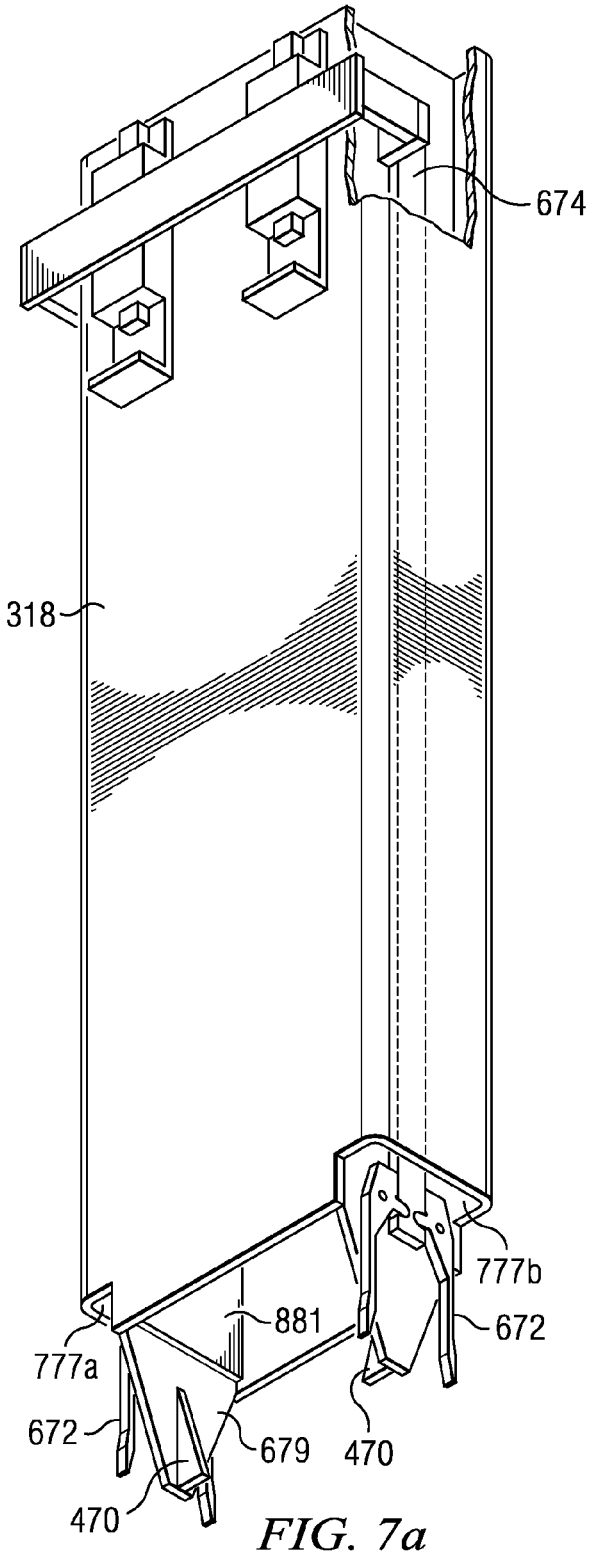
FIG. 7*a* is a perspective view showing the product delivery tube in one embodiment.
Figure 7B:
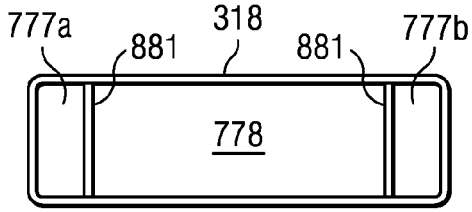
FIG. 7*b* is a top view showing the product delivery tube in one embodiment.

One embodiment wherein the extension 330 comprises movable fingers is shown in FIG. 7*a*. FIG. 7*a* is a perspective view showing the product delivery tube in one embodiment. FIG. 7*b* is a top view showing the product delivery tube in one embodiment. As can be seen, in one embodiment, the product delivery tube 318 comprises partitions 881. A partition is a physical boundary. As depicted the product delivery tube 318 comprises two partitions 881 which separates the product delivery tube 318 into three chambers though other number of chambers can be suitably used. The food or other product to be packaged flows through the bulk chamber 778. A vertical drive system is located in the left chamber 777*a* and the right chamber 777*b*. In one embodiment the bulk chamber 778 comprises about 80% of the product delivery tube 318. In one embodiment the left and/or right chamber 777 has a width of about ½ inch or less. The width is defined as the distance between the partition 881 and the external wall of the tube 318. In one embodiment the bulk chamber 778 has a width of between about 3 inches to about 7 inches between partitions 881. The thickness of the product delivery tube 318, measured from the front wall to a back wall, varies for the widths of the bags. In one embodiment the product delivery tube 318 ranges from a thickness of between about 2.5 and about 4 inches. Having a vertical drive system which is contained within a chamber having a width of ½ inch or less is beneficial in that it requires very little space to operate.

In one embodiment, as depicted in FIG. 7*b*, the partitions 881 are attached to the product delivery tube 318. In another embodiment the base 679 of the drive system acts as the partition. In such an embodiment the product delivery tube 318 is a single chamber which is separated into three chambers by the insertion of two vertical drive systems. In other embodiments, however, the product delivery tube 318 comprises partitions 881 which are coupled or otherwise affixed to the product delivery tube 318. In such embodiments the product delivery tube 318 comprises multiple chambers even in the absence of a vertical drive system. FIGS. 7*a* and 7*b* illustrate an embodiment wherein the product delivery tube 318 comprises partitions 881.

The partitions 881 separate the bulk chamber 778 from the left 777*a* and right chambers 777*b*. Such an embodiment separates the vertical drive system from the food which is to be packaged. This allows the vertical drive system to be made from a variety of materials as it is not required that the vertical drive system comprise food grade parts. Further, because the vertical drive system is separate from the food product, the vertical drive system requires less cleaning than would a drive system exposed to the oil, particulates, etc. of the food.

As depicted in FIG. 7*a*, there are two vertical drive systems, each located on a side of the product delivery tube 318. As can be seen, virtually all parts necessary for the operation of the fingers 672 are contained within the product delivery tube 318. In one embodiment all parts required for the operation of the fingers 672 save for the equipment which acts upon the lever 674 is contained within the product delivery tube 318. This is a vast improvement of the prior art which often required external air cylinder activation located at or near the extension 330 to operate the extension 330. For example, referring to FIG. 3*a*, air cylinders or devices for activating the air cylinders such as buttons were often located below the drive belt 320 and along the upper portion of the extension 330. Because of the presence of air cylinders located in the vicinity of the extension 330, the foot print of the vertical form, fill, and seal machine was increased. As can be seen from FIG. 7*a*, however, a vertical drive system, in one embodiment, requires far less space. Further, as noted, the vertical drive system permits a vertical force to be converted into a horizontal or rotational force. Such conversion results in an efficient use of the space around and within the product delivery tube 318. As noted, this conversion eliminates the need to have bulky equipment located near the fingers 672 which would provide the horizontal or rotational force. As described, an actuator or other equipment can be located near the top of the product delivery tube 318 and can apply a vertical force to the lever 674. The vertical drive system then converts the vertical force into a rotational or horizontal force as needed. As such, the vertical drive system allows the actuator or other such equipment to be remotely located relative to the fingers 672.

Furthermore, in one embodiment the vertical drive system requires fewer moving parts. Having fewer moving parts is an advantage because fewer moving parts typically equates to less down time due to maintenance. As can be seen in FIG. 6*a*, the lever 674 and the fingers 672 are really the only moving parts aside from the equipment which operates the lever 674. Additionally, by requiring fewer parts, there are fewer parts which could potentially break off during operation. This is always a concern in food packaging as it is undesirable that machinery parts would be packaged in a food package. Further, because the vertical drive system is partitioned from the bulk chamber 778, even if a part such as the pivot 673 became loose, the likelihood that it would be packaged is significantly minimized. Additionally, in one embodiment the vertical drive system and its parts are so dimensioned so that the vertical drive system fits snugly within the chamber. In such embodiments because the vertical drive system is snugly situated within a chamber if parts did break off it would be very difficult, if not virtually impossible, for the broken piece to fall downstream where it could be packaged. As stated the friction and compressive forces maintain dislodged pieces within the chamber. As such, loose or dislodged machinery is prevented from falling and becoming packaged.

The lever 674 can be operated with any equipment known in the art. In one embodiment, as shown in FIG. 7*a*, the lever 674 is manipulated with an actuator.

The vertical drive system operates as previously described. For example, in one embodiment the fingers 672 are manipulated into the refracted position. In the retracted position the sealing jaws 326 make an end seal. When retracted, in one embodiment, the fingers 672 point in the direction of the centerline of the sealing jaws 326. Such operation permits the sealing jaws 326 to close and form a transverse seal while simultaneously minimizing or eliminating the creation of tucks or pleats. In one embodiment, as shown in FIG. 7*a*, there are two vertical drive systems each with a pair of fingers 672. Each pair of fingers 672 act on one end of a package. Thus, in one embodiment an end seal is formed with a pair of sealing jaws to form an open-ended tube.

Thereafter, the fingers 672 are manipulated into an extended position. As noted, in one embodiment this step comprises vertically displacing the lever 674 relative to the base 679 so that the fingers 672 rotate about the pivot 673. Thus, the vertical displacement results in the fingers 672 achieving the extended position. While in the extended position the fingers create and define the package bottom 250 which has a pair of outwardly-extending flaps 260, as shown in FIG. 5*c*. A folding device 350 then folds the bottom transverse seal 230. The outwardly-extending flaps 260 can be folded and sealed to the bottom of the package as previously described. For example a folding member 360 such as shown in FIG. 3*e* can be utilized. Likewise, in one embodiment the folding member 360 comprises a pivoting extension 362 such as shown in FIG. 3*e*. In one embodiment the fingers 672 maintain the extended position until the other machinery has been moved. For example, in one embodiment the fingers 672 maintain the extended position while the folding device 350 is removed. The fingers 672 maintain the extended position when the folding member 360 is withdrawn. Thereafter the fingers 672 are manipulated into the retracted position, and the process is repeated.

As previously noted, a pedestal 470 can be utilized to apply vertical pressure to the package bottom 250 which aids in the sealing of the flaps 260. In one embodiment the pedestal 470 is coupled to the base 679 of the vertical drive system. As can be seen in FIG. 7*a*, in one embodiment the pedestal 470 only extends outward from the base 679 in one direction. As depicted, the pedestal 470 does not extend in the direction of the fingers 672. This ensures the pedestal 470 does not disrupt the operation of the fingers 672. Furthermore, in some embodiments if the pedestal 470 extended in the direction of the fingers 672 this would interfere with the folding device 350. It should be noted that while the folding device 350 is depicted as having three forks this should not be deemed limiting. In other embodiments the fork can comprise virtually any number of forks. Applicants have discovered in one embodiment that increased surface area of the folding device 350 in the area which contacts the seals results in better folds. As such, in one embodiment wherein the folding device 350 comprises three forks, the middle fork is wider compared to the outer forks. This results in increased surface area on the front edge of the folding device 350. However, in one embodiment comprising a pedestal 470, the folding device 350 does not cover the area above the location of the pedestal 470. Put differently, in some embodiments, there are gaps, holes, etc., such as those shown in FIG. 3*e*, in the folding device 350 so that the pedestal 470 is not covered by the folding device 350. This allows pressure to be applied to the pedestal 470.

In another embodiment, the pedestal 470 extends in both directions from the face of the base 679. This increases the available surface area of the pedestal 470. In one embodiment the pedestal extends outwardly in substantially a perpendicular direction from the face of the base 679. The pedestal 470 can be welded, soldered, or otherwise affixed to the base 679. In other embodiments the pedestal 470 is made integral to the base 679.

In one embodiment the vertical drive system can be slidably removed from its chamber 777. As shown in FIG. 7*a*, due to the presence of the pedestal 470, the vertical drive system is installed and removed through the bottom of the product delivery tube 318.

Figure 8:
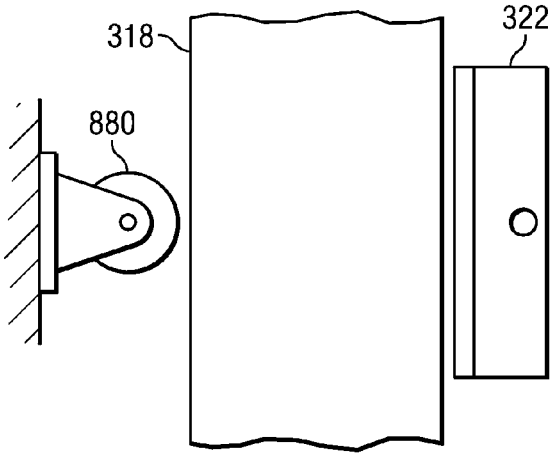
FIG. 8 is a side profile view of one embodiment utilizing a product delivery tube brace.

In one embodiment the vertical form, fill, and seal machine further comprises a product delivery tube brace. FIG. 8 is a side profile view of one embodiment utilizing a product delivery tube brace. Often when the vertical sealer 322 makes its seal it applies pressure to the product delivery tube 318 which causes the product delivery tube 318 to move slightly. This is not typically a problem if making typical pillow pouch packages. However, because the outwardly-extending flaps 260 can be folded and sealed to form the flat bottom, if the product delivery tube 318 undesirably moves the flaps 260 become misaligned during the fold. Thus, rather than resulting in the package of 5*d* wherein the flaps 260 are folded over the seal 230, the flaps 260 do not overlay the seal 230. In one embodiment, providing a brace 880 which limits the movement of the product delivery tube limits or eliminates flap 260 misalignment. The brace 880 can comprise a variety of devices. In one embodiment the brace 880 comprises a wheel or other rotatable device. Because film is being pulled downward, when the product delivery tube 318, and consequently the film, is pressed against the brace 880, the rotatable device prevents the downwardly moving film from becoming stuck or undesirably slowed by the brace 880. The brace 880 can be positioned at virtually any location along the product delivery tube 318. The brace 880, as used herein, refers to any device which applies pressure to counter the pressure applied by the vertical sealer 322. In one embodiment the brace 880 is located at the same height as the vertical sealer 322 and positioned approximately 180° away from the vertical sealer 322. In one embodiment the brace 880 is positioned between about 1/16 to about 1/32 of an inch from the product delivery tube 318.

There are several advantages provided by the present invention. First, because the package comprises no gussets, use of a lower gauge flexible film can be used because of the reduction in the number of problem areas where pinhole leaks can occur. The flat bottom pouch of the present invention can be made from film than is less than 180 gauge in thickness. Consequently, the flat bottom pillow pouch can be made with at least 33% less film than is required for the prior art embodiment depicted in FIG. 1*a*-1*d*. In other embodiments film with a thickness of between 150 and 300 gauge is used. In one embodiment, the film used for the present invention consists of a metalized OPP layer having a sealant layer and a reverse printed polymer layer that is laminated with polyethylene or other suitable adhesive layer to the metalized OPP film. Consequently, in one embodiment, the package of the present invention is made from the same film as a pillow package. The invention provides a package and method for making the same from a flexible material without the need for crease lines to be stamped or otherwise impressed into the package film prior to making the package.

An advantage of the present invention is that the top and bottom transverse seals are made without any side gussets. Further, because there are fewer locations for the occurrence of pinholes, the package of the present invention provides more consistent shelf-life. The present invention provides a way to make flat bottom pillow pouches by modifying a standard vertical form fill and seal machine.

While this invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

1. A method for making a pillow pouch having a flat bottom, said method comprising the steps of:

a) forming a first end seal with a pair of sealing jaws to form an open-ended tube wherein said first end seal is formed beneath a product delivery tube having at least one pair of fingers in a retracted position;

b) providing said at least one pair of fingers in an extended position thereby forming a package bottom having a pair of outwardly-extending flaps;

c) folding said end seal with a folding device;

d) folding each of said flaps inwardly and beneath said package bottom.

2. The method according to any preceding clause, wherein said providing in step b) comprises vertically displacing a lever, wherein said lever is coupled to said at least one pair of fingers, such that said vertical displacement results in said at least one pair of fingers achieving said extended position.

3. The method according to any preceding clause, wherein said folding of said first end seal comprises folding with a fork having at least two fingers and an open area therebetween.

4. The method according to any preceding clause, wherein said tube comprises film having a thickness of between 150 and 300 gauge.

5. The method according to any preceding clause, wherein said folding of said first end seal occurs such that a folded end seal is created that is substantially 90 degrees from the top end seal.

6. The method according to any preceding clause, wherein said flaps are sealed to said bottom of said package.

7. The method according to any preceding clause, wherein step d) further comprises the step of applying vertical pressure between each of said flaps and said package bottom.

8. The method according to any preceding clause, further comprises sealing said flaps to the bottom of the package.

9. The method according to any preceding clause, wherein said product delivery tube further comprises a pedestal.

10. The method according to any preceding clause, wherein said folding of step d) is performed by a folding member, wherein said folding member comprises a pivoting extension.

11. The method according to any preceding clause, wherein said pivoting extension apply a vertical pressure.

12. The method according to any preceding clause, wherein said fingers are substantially parallel with said product delivery tube when in said extended position.

13. The method according to any preceding clause, further comprising the step of forming a second end seal with a pair of sealing jaws.

14. A vertical form, fill, and seal machine, said machine comprising:

a product delivery tube having an extension, wherein said extension comprises at least one pair of fingers being movable between an extended position and a retracted position;

a folding device for folding a bottom, transverse seal adjacent to a package bottom thereby creating a pair of flaps; and a pair of side folding members wherein each folding member holds each flap beneath said package bottom.

15. The machine according to clause 14, wherein each of said side folding members further comprise a pivoting extension.

16. The machine according to clauses 14-15, wherein said extension further comprises at least one pedestal.

17. The machine according to clauses 14-16, wherein said machine consists of a single vertical sealing device.

18. The machine according to clauses 14-17, wherein said product delivery tube comprises partitions.

19. The machine according to clause 18, wherein said partitions form three chambers, wherein said chambers comprise a bulk chamber, a left chamber, and a right chamber.

20. The machine according to clause 19, wherein said left chamber comprises an extension, and wherein said right chamber comprises an extension.

21. The machine according to clauses 14-20, wherein said extension is coupled to a vertical drive system.

22. The machine according to clauses 14-21, wherein said at least one pair of fingers is coupled to a lever.

23. The machine according to clause 22, wherein when said lever is vertically displaced said at least one pair of fingers moves between said extended and retracted position.

24. The machine according to clause 22, wherein said lever comprises two notches and wherein each of said fingers comprises a handle, and wherein of said handle fits within said notch.

25. The machine according to clauses 14-24, further comprising a product delivery tube brace.

26. The machine according to clause 25, wherein said machine further comprises a vertical sealer, and wherein said brace is located about 180 degrees from said vertical sealer.

27. The machine according to clauses 14-26, wherein said extension extends below said product delivery tube.

28. A method for making a pillow pouch having a flat bottom, said method comprising the steps of:

a) forming a tube of packaging film on a vertical form fill and seal machine;

b) forming an end seal on said tube, wherein said end seal comprises no tucks, wherein said end seal is formed beneath a product delivery tube having at least one pair of fingers in a retracted position, wherein said fingers extend down below said product delivery tube;

c) positioning said fingers in an extended position thereby defining a flat bottom;

d) folding said end seal with a folding device to make a plurality of flaps; and e) folding each of said flaps inwardly and beneath said package bottom.

29. The method according to clause 28, wherein said packaging film comprises a thickness of between 150 and 300 gauge.

30. The method according to clause 28, further comprising the step of applying vertical pressure between each of said flaps and said package bottom.

What is claimed is:

1. A method for making a package having a flat bottom, said method comprising the steps of:

a) forming a first end seal with a pair of sealing jaws to form an open-ended tube wherein said first end seal is formed beneath a product delivery tube having at least two pairs of fingers in a retracted position;

b) providing said at least two pairs of fingers in an extended position thereby forming a package bottom having a pair of outwardly-extending flaps;

c) folding said first end seal with a folding device;

d) folding each of said flaps inwardly and beneath said package bottom.

2. The method of claim 1 wherein said providing in step b) comprises vertically displacing a lever, wherein said lever is coupled to at least one pair of fingers, such that said vertical displacement results in at least one pair of fingers achieving said extended position.

3. The method of claim 1 wherein said folding of said first end seal comprises folding with a fork having at least two fingers and an open area therebetween.

4. The method of claim 1 wherein said tube comprises film having a thickness of between 150 and 300 gauge.

5. The method of claim 1 wherein said folding of said first end seal occurs such that a folded end seal is created that is substantially 90 degrees from a top end seal.

6. The method of claim 1 wherein said flaps are sealed to said bottom of said package.

7. The method of claim 1 wherein step d) further comprises the step of applying vertical pressure between each of said flaps and said package bottom.

8. The method of claim 1 further comprises sealing said flaps to the bottom of the package.

9. The method of claim 1 wherein said product delivery tube further comprises a pedestal.

10. The method of claim 1 wherein said folding of step d) is performed by a folding member, wherein said folding member comprises a pivoting extension.

11. The method of claim 10 wherein said pivoting extension applies a vertical pressure.

12. The method of claim 1 wherein said fingers are substantially parallel with said product delivery tube when in said extended position.

13. The method of claim 1 further comprising the step of forming a second end seal with a pair of sealing jaws.

14. A vertical form, fill, and seal machine, said machine comprising:

a product delivery tube having an extension, wherein said extension comprises at least two pairs of fingers being movable between an extended position and a retracted position;

a folding device for folding a bottom, transverse seal adjacent to a package bottom thereby creating a pair of flaps; and a pair of side folding members wherein each folding member folds each flap beneath said package bottom.

15. The machine of claim 14 wherein each of said side folding members further comprise a pivoting extension.

16. The machine of claim 14 wherein said extension further comprises at least one pedestal.

17. The machine of claim 14 wherein said machine consists of a single vertical sealing device.

18. The machine of claim 14 wherein said product delivery tube comprises partitions.

19. The machine of claim 18 wherein said partitions form three chambers, wherein said chambers comprise a bulk chamber, a left chamber, and a right chamber.

20. The machine of claim 19 wherein said left chamber comprises an extension, and wherein said right chamber comprises an extension.

21. The machine of claim 14 wherein said extension is coupled to a vertical drive system.

22. The machine of claim 14 wherein at least one pair of fingers is coupled to a lever.

23. The machine of claim 22 wherein when said lever is vertically displaced at least one pair of fingers moves between said extended and retracted position.

24. The machine of claim 22 wherein said lever comprises two notches and wherein each of said fingers comprises a handle, and wherein of said handle fits within said notch.

25. The machine of claim 14 further comprising a product delivery tube brace, wherein said product delivery tube brace comprises a rotatable device.

26. The machine of claim 25 wherein said machine further comprises a vertical sealer, and wherein said brace is located about 180 degrees from said vertical sealer.

27. The machine of claim 14 wherein said extension extends below said product delivery tube.

28. A method for making a package having a flat bottom, said method comprising the steps of:

a) forming a tube of packaging film on a vertical form fill and seal machine;

b) forming an end seal on said tube, wherein said end seal comprises no tucks, wherein said end seal is formed beneath a product delivery tube having at least two pairs of fingers in a retracted position, wherein said fingers extend down below said product delivery tube;

c) positioning said fingers in an extended position thereby defining a flat bottom in said package;

d) folding said end seal with a folding device to make a plurality of flaps; and e) folding each of said flaps inwardly and beneath said package bottom.

29. The method of claim 28 wherein said packaging film comprises a thickness of between 150 and 300 gauge.

30. The method of claim 28 further comprising the step of applying vertical pressure between each of said flaps and said package bottom.

* * * * *